US006004254A

United States Patent [19]

Murata

[11] Patent Number: 6,004,254

[45] Date of Patent: Dec. 21, 1999

[54] SHEET FOLDING APPARATUS AND IMAGE FORMING APPARATUS

[75] Inventor: Mitsushige Murata, Abiko, Japan

[73] Assignee: Canon Kabushiki Kaisha, Tokyo, Japan

[21] Appl. No.: 09/018,568

[22] Filed: Feb. 4, 1998

[30] Foreign Application Priority Data

Feb. 5, 1997 [JP] Japan ..... 9-022452

[51] Int. Cl.[6] ..... B31F 1/14

[52] U.S. Cl. ..... 493/444; 493/435; 493/419

[58] Field of Search ..... 493/444, 445, 493/435, 419, 420, 421, 320, 321, 385; 270/32, 37, 58.09, 58.08

[56] References Cited

U.S. PATENT DOCUMENTS

| | | | |
|---|---|---|---|
| 3,632,104 | 1/1972 | Dufour | 270/83 |
| 3,904,187 | 9/1975 | Hertrich et al. | 270/83 |
| 3,995,850 | 12/1976 | Hertrich et al. | 270/83 |
| 4,616,815 | 10/1986 | Vijuk | 270/45 |
| 4,816,108 | 3/1989 | Beck et al. | 156/356 |
| 5,020,785 | 6/1991 | Kosaka et al. | 270/53 |
| 5,129,640 | 7/1992 | Kosaka et al. | 270/53 |
| 5,147,275 | 9/1992 | Staniszewski | 493/416 |
| 5,267,935 | 12/1993 | Bialek et al. | 493/444 |
| 5,551,939 | 9/1996 | Deckers | 493/442 |
| 5,568,247 | 10/1996 | Murata et al. | 355/324 |
| 5,709,640 | 1/1998 | Timmermans et al. | 493/23 |
| 5,769,404 | 6/1998 | Kanou et al. | 270/37 |

*Primary Examiner*—Joseph J. Hail, III
*Assistant Examiner*—William Hong
*Attorney, Agent, or Firm*—Fitzpatrick, Cella, Harper & Scinto

[57] ABSTRACT

The present invention provides a sheet folding apparatus comprising a folding means for folding a sheet by feeding a folded portion of the sheet by a pair of rotary members, in which the folded portion of the sheet is passed through a nip between the pair of rotary members by plural times by rotating said pair of rotary members in normal and reverse directions alternately. It further comprises a switch-back control means for controlling so that a return speed of the sheet obtained by the pair of rotary members becomes slower than an advancing speed of the sheet.

21 Claims, 24 Drawing Sheets

SHEET FOLDING APPARATUS AND IMAGE FORMING APPARATUS

BACKGROUND OF THE INVENTION

1. Field of the Invention

The present invention relates to a sheet folding apparatus and an image forming apparatus having such a sheet folding apparatus, and more particularly, it relates to an image forming apparatus having a sheet folding apparatus in which a sheet bundle including sheets on which images were formed by the image forming apparatus is stapled and bundle-folded to form a book.

2. Related Background Art

In conventional sheet folding apparatuses, a pair of rollers are used as a folding means and sheet bundle is folded as half fold when the sheet bundle is passed through a nip between the paired rollers. When a thickness of the sheet bundle is relatively great, after the half-folded sheet bundle is passed through the nip between the paired rollers once, the pair of rollers are rotated reversely to pass the sheet bundle through the nip again to reduce the swelling of a folded line of the sheet bundle, or, the folded sheet bundle is reciprocally passed through the nip by several times to reduce the swelling of the folded line of the sheet bundle.

A speed of the sheet bundle entering into the nip between the paired rollers is set to be relatively great because the sheet bundle must be entered into the nip in opposition to pressure of the nip between the paired rollers, and it is generally designed so that the speed of the sheet bundle entering into the nip becomes the same as a speed of the sheet bundle leaving the nip.

However, in the above-mentioned conventional technique, since the speed of the sheet bundle leaving the nip between the paired roller is set to be relatively great, sufficient pressure cannot be applied to the folded line of the sheet bundle not to reduce the swelling of the folded line of the sheet bundle sufficiently. Thus, the number of reciprocations of the sheet bundle passing through the nip must be increased, thereby reducing the productivity. Further, when the sheet bundle is reciprocated through the nip between the paired rollers by plural times, the vicinity if the folded line of the sheet bundle is smudged by the sliding contact between the rollers and the sheet bundle, to thereby worsen the quality of the finished article and reducing the reliability of the apparatus.

SUMMARY OF THE INVENTION

The present invention intends to eliminate the above-mentioned conventional drawbacks, and has an object to provide a sheet folding apparatus which can improve processing ability for folding a sheet bundle and maintain quality of the sheet bundle, and an image forming apparatus having such a sheet folding apparatus.

To achieve the above object, according to the present invention, there is provided a sheet folding apparatus comprising a folding means for folding a sheet by feeding a folded portion of the sheet by a pair of rotary members. Wherein the folded portion of the sheet is passed through a nip between the pair of rollers by plural times by rotating the pair of rollers in a normal direction and a reverse direction alternately. It further comprises a switch-back control means for controlling so that a return speed of the sheet obtained by the pair of rollers becomes slower than an advancing speed of the sheet.

With this arrangement, by controlling by means of the switch-back control means so that the drawing speed (return speed) of the sheet bundle with respect to the folding means becomes slower than the advancing speed of the sheet bundle with respect to the folding means, adequate pressure acts on the folded line of the sheet bundle since the drawing speed for drawing the sheet bundle from the folding means becomes small. As the result that, even when a thickness of the sheet bundle is relatively great, the swelling of the folded line of the sheet bundle can be reduced effectively, and the number of reciprocations of the sheet bundle passing through the pair of rollers can be reduced, to thereby maintain the good quality of the book-bound sheet bundle and improve the reliability of the apparatus.

DETAILED DESCRIPTION OF THE PREFERRED EMBODIMENTS

An electrophotographic copying machine having a finishing apparatus as an example of an image forming apparatus having a sheet processing apparatus according to the present invention will be fully explained with reference to the accompanying drawings.

Figure 1:
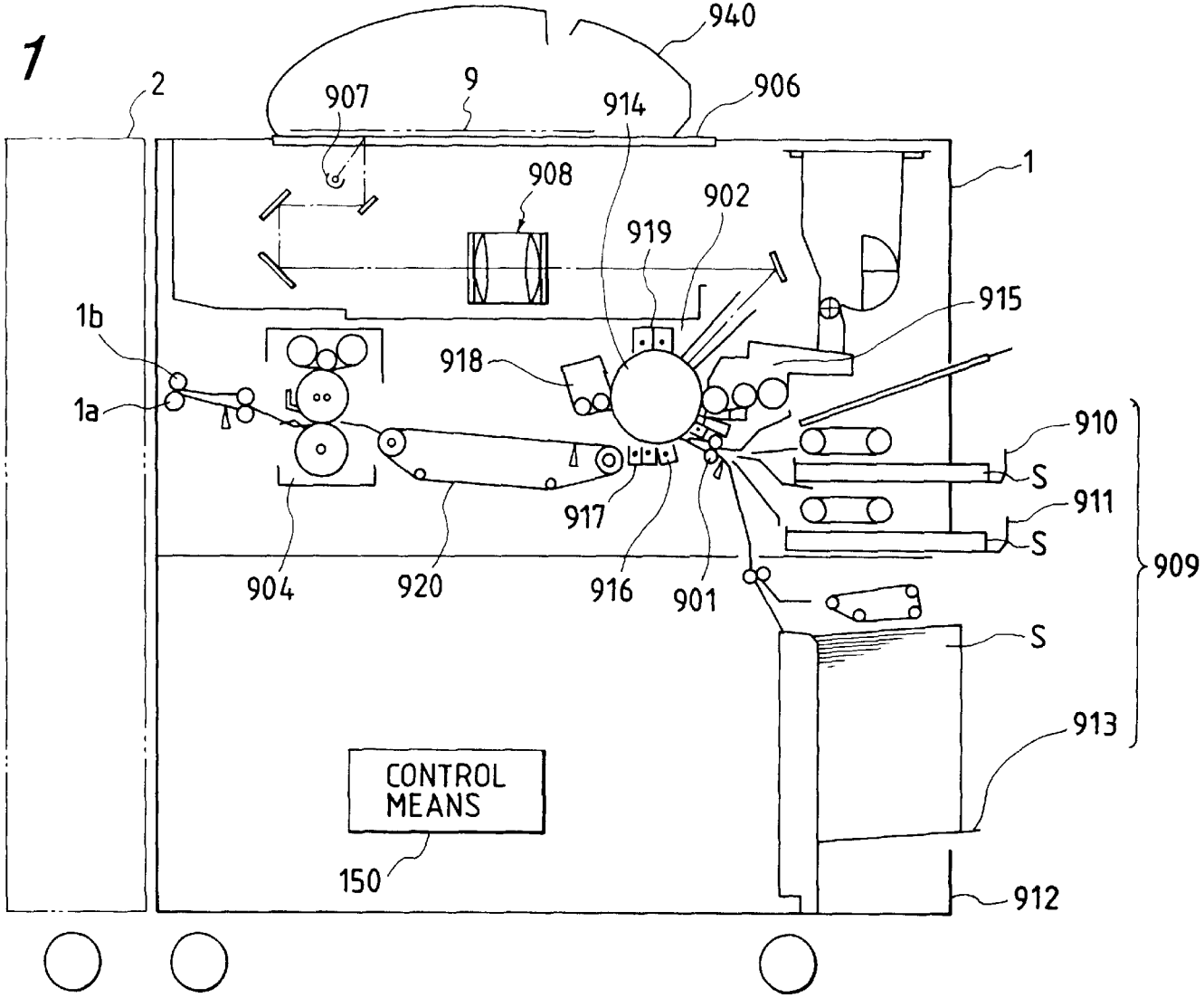
FIG. 1 is an elevational sectional view showing an entire construction of a sheet processing apparatus according to the present invention and an image forming apparatus having such a sheet folding apparatus.

First of all, the entire construction of the image forming apparatus having the sheet processing apparatus according to the present invention will be described with reference to FIG. 1. In FIG. 1, a main body 1 of the image forming apparatus comprised of an electrophotographic copying machine includes a platen glass (original resting plate) 906, a light source 907, a lens system 908, a sheet supply portion (sheet convey means) 909 and an image forming portion (image forming means) 902.

An automatic original supplying device 940 for automatically supplying an original 9 onto the platen glass 906 is rested on the body 1 of the image forming apparatus. A finishing apparatus 2 as a sheet processing apparatus according to the present invention is connected to the body 1 of the image forming apparatus. The sheet supply portion 909 includes sheet cassettes 910, 911 which contain sheets S made of paper or synthetic resin and which is detachably mounted to the body 1 of the image forming apparatus, and a sheet deck 913 mounted on a pedestal 912.

The image forming portion 902 includes a cylindrical electrophotographic photosensitive drum 914, a developing device 915, a transfer charger 916, a separation charger 917, a cleaning device 918 and a first charger 919, and the elements 915 to 919 are disposed around the photosensitive drum 914. A convey belt 920, a fixing device 904 and a pair of discharge rollers 1*a*, 1*b* are disposed at a downstream side (in a sheet conveying direction) (referred to merely as "downstream side" hereinafter) of the image forming portion 902.

Next, an operation of the image forming apparatus 1 will be explained. When a sheet supply signal is emitted from a control device 150 including a switch-back control means provided within the image forming apparatus 1, the sheet S is selectively supplied from the sheet cassette 910 or 911 or the sheet deck 913.

On the other hand, light from the light source 907 is illuminated onto an imaged surface of the original 9 rested on the platen glass 906 with the imaged surface facing downside, and light reflected from the imaged surface is illuminated onto a surface of the photosensitive drum 914 through the lens system 909 comprised of a mirror and a lens. The surface of the photosensitive drum 914 is previously charged by the first charger 919 uniformly. When the light is illuminated on the surface of the photosensitive drum 914, an electrostatic latent image is formed on the photosensitive drum, and then, is developed by the developing device 915 to form a toner image.

The sheet S supplied from the sheet supply portion 909 reaches a pair of regist rollers 901, where skew-feed of the sheet is corrected. Then, in synchronous with the rotation of the photosensitive drum 914, the sheet is sent to the image forming portion 902 between the photosensitive drum 914 and the transfer charger 916. In the image forming portion 902, the toner image formed on the photosensitive drum 914 is transferred onto the sheet S (sent by the pair of regist rollers 901) by the transfer charger 916, and the sheet to which the toner image was transferred is separated from the photosensitive drum 914 by charging the sheet by the separation charger 917 with polarity opposite to that of the transfer charger 916.

The separated sheet S is absorbed onto the convey belt and then is sent to the fixing device 904, where the toner image is permanently fixed to the sheet by heat and pressure. Thereafter, the sheet S is discharged out of the image forming apparatus 1 by the pair of discharge rollers 1*a*, 1*b* and then is sent to the finishing apparatus 2 connected to the image forming apparatus at a downstream side.

Next, the finishing apparatus 2 as the sheet processing apparatus according to the present invention will be fully described. In the finishing apparatus 2, after a sheet bundle (including the sheets on which the images were formed) is stapled, the sheet bundle is half-folded for book-binding.

Figure 2:
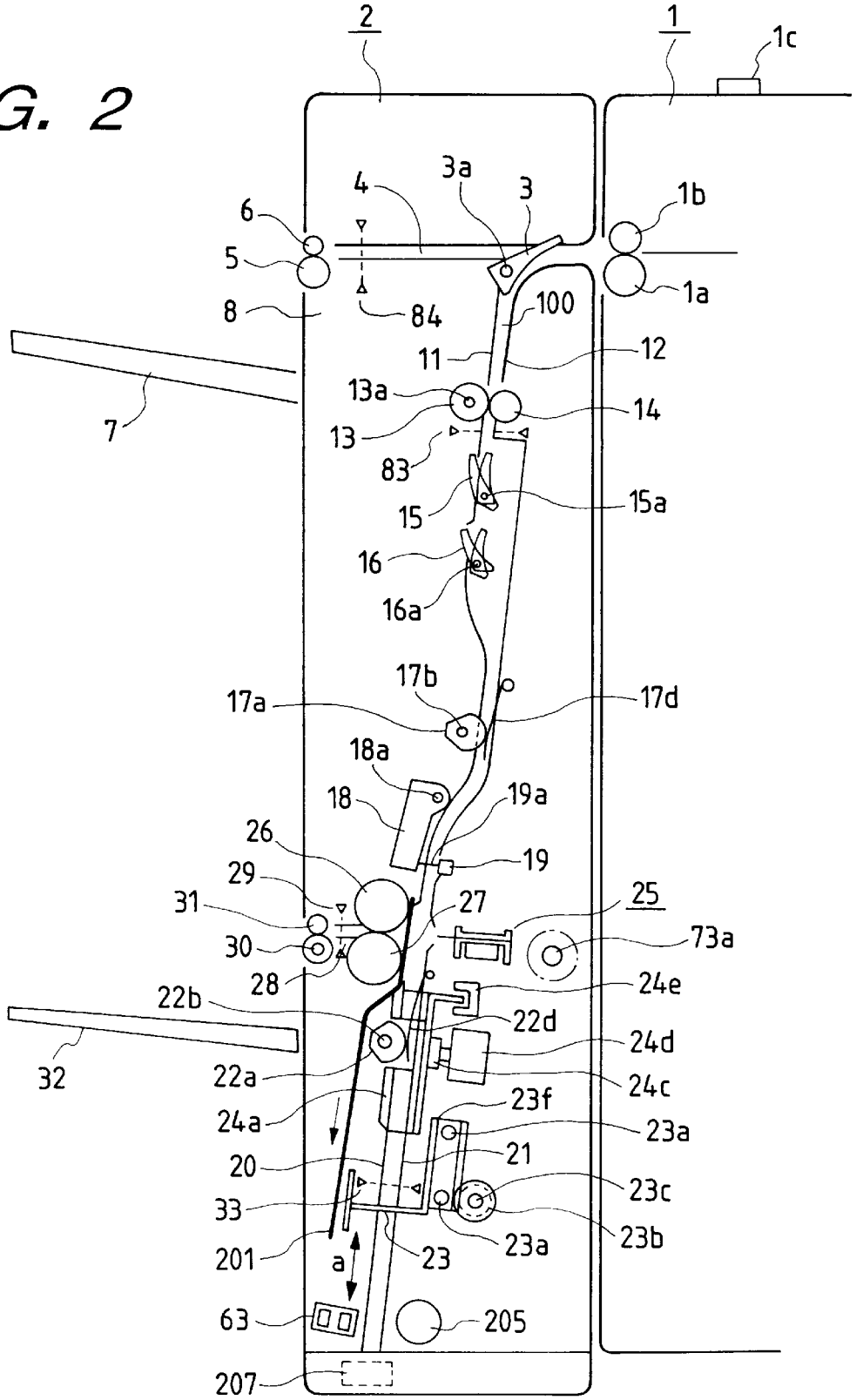
FIG. 2 is a sectional view of the sheet processing apparatus according to the present invention.

In FIG. 2, the discharge roller 1*a* is rotated by a drive motor (not shown) and the discharge roller 1*b* is urged against the discharge roller and is rotatingly driven by rotation of the discharge roller 1*a*. A fold mode select switch 1*c* serves to select whether the sheet bundle S (constituted by the sheets S discharged from the image forming apparatus 1 and introduced into the finishing apparatus 2) is stapled and half-folded or the sheet bundle S is not stapled and half-folded.

Figure 8:
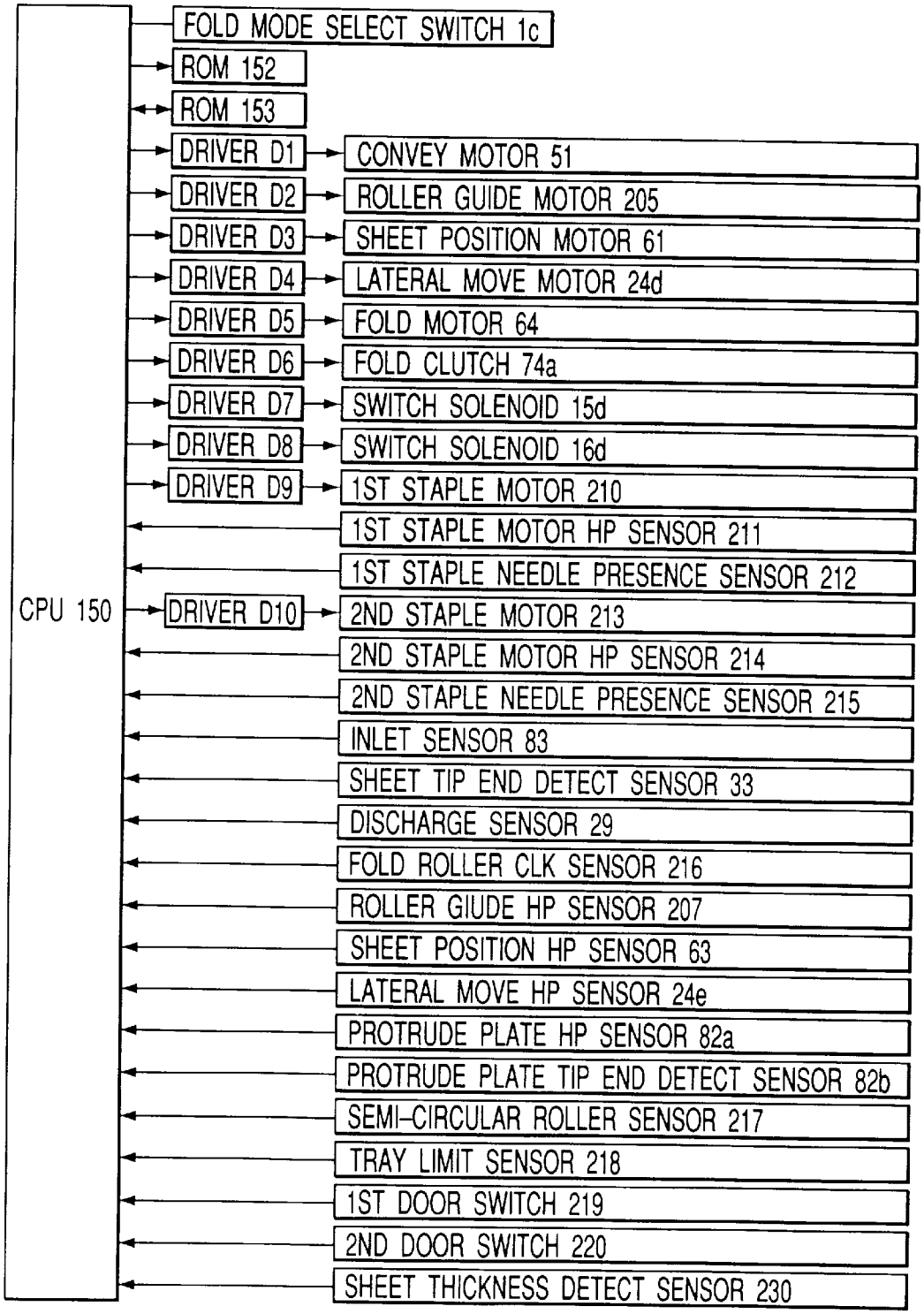
FIG. 8 is a block diagram showing a control system of the sheet processing apparatus.

As shown in FIG. 8, a signal of the fold mode selection switch lc is sent to a control device (CPU: central processing unit) 150 provided in the image forming apparatus 1, so that image forming control corresponding to the selected fold mode is performed by the control device 150.

Figure 3:
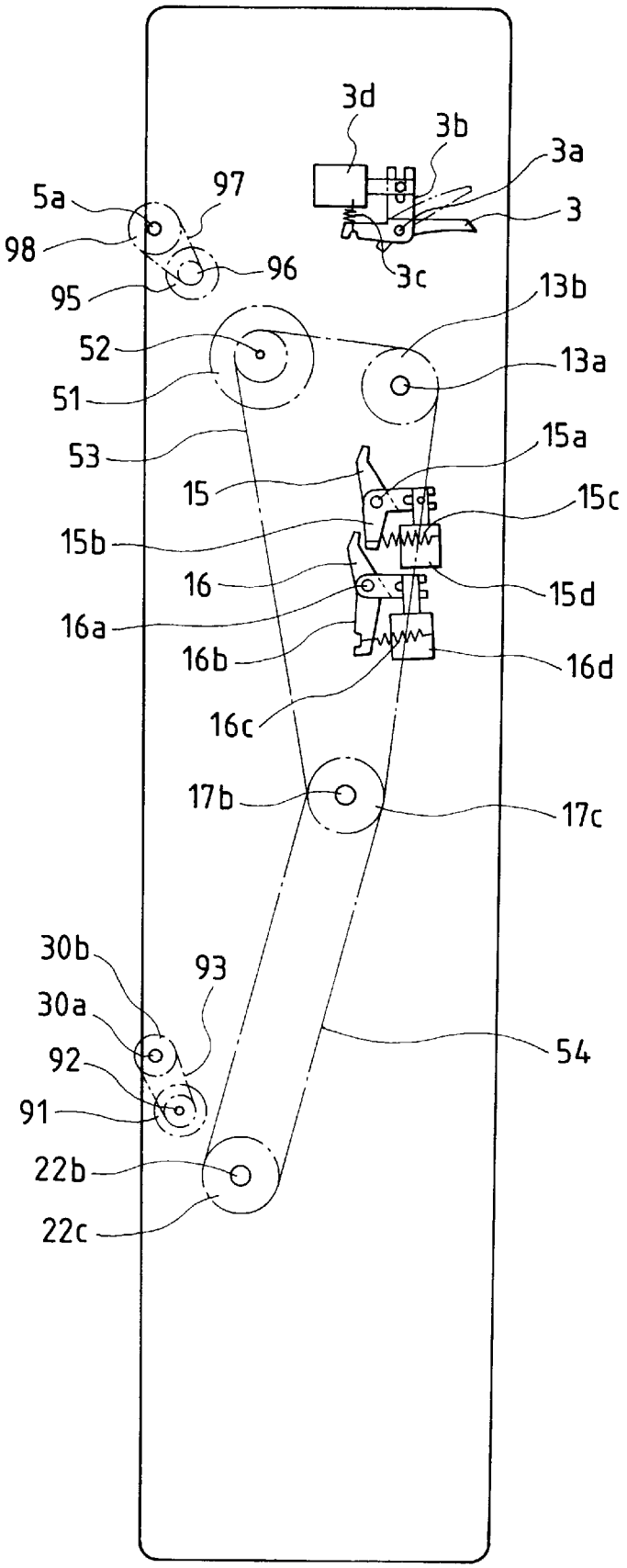
FIG. 3 is a front view showing a drive portion of a sheet convey system of the sheet processing apparatus.

As shown in FIG. 3, an inlet flapper 3 is driven by an inlet solenoid 3*d* so that the switching between a book-bind mode and a stack mode can be effected by ON/OFF of the inlet solenoid 3*d*. A stack discharge roller 5 and a discharge sub-roller 6 urged against the stack discharge roller 5 and rotatingly driven by rotation of stack discharge roller are disposed downstream of a discharge guide 4. The sheets S discharged from the stack discharge roller 5 are stacked on a stack tray 7.

The reference numerals 11, 12 denote sheet guides; and 13 denotes a convey roller. A convey sub-roller 14 is urged against the convey roller 13 and is rotatingly driven by rotation of the convey roller. The sheet S is conveyed, by the convey roller 13 and the convey sub-roller 14, to a sheet positioning member (first sheet containing means) 23 which will be described later. Upper and lower switch flappers 15, 16 are disposed downstream of the convey roller 13. As shown in FIG. 3, the switch flappers 15, 16 are driven by switch solenoids 15*d*, 16*d*, respectively. Each switch flapper 15, 16 can occupy a position shown by the broken line in FIG. 2 or a position shown by the solid line in FIG. 2 selectively by ON/OFF of the corresponding switch solenoids 15*d*, 16*d* controlled by an electric signal.

Semi-circular rollers 17*a*, 22*a* are disposed downstream of the switch flappers 15, 16, and elastic members (leaf springs) 17*d*, 22*d* are urged against the semi-circular rollers 17*a*, 22*a*, respectively. A staple unit (stapling means) 18 is disposed downstream of the semi-circular roller 17*a* and upstream (in the sheet conveying direction) (referred to merely as "upstream" hereinafter) of the semi-circular roller 22*a*, and the staple unit 18 includes plate-shaped staple needles and a motor for driving the staple unit 18.

The staple unit 18 can be rocked around a rotary shaft 18*a*. When the staple unit 18 is rocked around the rotary shaft 18*a*, tip ends of a laid U-shaped staple needle is guided by an anvil 19 to bend the tip ends of the staple needle inwardly, to thereby staple the sheet bundle S.

Sheet guides 20, 21 are disposed at a downstream side of the staple unit 18, and lateral move members 24*a*, 24*b* (FIG. 4) contact with both lateral edges of the sheets S to align the sheets S.

The sheet positioning member (first sheet containing means) 23 is guided by the sheet guides 20, 21 to enter between the sheet guides 20 and 21 and abuts against tip ends of the sheets S dropped by their own weights, to thereby position the tip ends of the sheets. On the other hand, the lateral positioning of the sheets S is effected by the lateral move members 24*a*, 24*b*. The sheets S on which the images were successively formed in the image forming apparatus 1 are temporarily stacked and contained in a first sheet containing portion constituted by the sheet positioning member 23, sheet guides 20, 21 and lateral move members 24*a*, 24*b*, to thereby form an aligned sheet bundle S.

The number of sheets S contained in the first sheet containing portion constituted by the sheet positioning member 23, sheet guides 20, 21 and lateral move members 24*a*, 24*b* is counted by a sheet number counter CNT1 provided in the control device 150 (FIG. 1).

The sheet positioning member 23 can be shifted between upper and lower ends of the sheet guides 20, 21 in a direction shown by the arrow a in FIG. 2 (up-and-down direction), and a sheet tip end detect sensor 33 for detecting the tip end of the sheet S is provided on the sheet positioning member 23. The sheet positioning member 23 determines a position where the staple needle is stapled into the sheet bundle by the staple unit 18 and determines a position where the sheet bundle is half-folded (described later).

Before the sheet bundle S is folded, as shown in FIG. 2, a protrude unit 25 is retracted to a position where the protrude unit is retracted from a sheet convey path, i.e., a position at the right of the sheet guides 20, 21 in FIG. 2.

A pair of fold rollers (folding means) 26, 27 are urged against each other. As will be described fully, the pair of fold rollers are controlled by the control device (switch-back control means) 150 so that, when a single sheet S is folded, the sheet S is conveyed at a predetermined normal speed; whereas, when the sheet bundle having two or more sheets S is folded, the sheet bundle is conveyed at a first speed slower than the normal speed. Further, after the sheet bundle is shifted by a predetermined amount by the pair of fold rollers 26, 27, the pair of fold rollers 26, 27 are controlled so that the sheet bundle is conveyed at a second speed greater than the first speed.

A discharge guide 28 guides the sheet bundle S discharged from the pair of fold rollers 26, 27 to a nip between a discharge roller 30 and a discharge sub-roller 31 urged against the discharge roller 30. A discharge sensor 29 serves to detect tip and trail end of the sheet bundle S.

Next, the operations of the inlet flapper 3, switch flappers 15, 16, convey roller 13 and semi-circular rollers 17*a*, 22*a* will be fully described with reference to FIGS. 2 and 3. The inlet flapper 3 can be rocked around a center shaft 3*a*, and a link 3*b* is secured to one end of the center shaft 3*a*. A spring 3*c* is connected to the link 3*b* so that the inlet flapper 3 is always biased toward clock-wise direction (FIG. 3) around the center shaft 3*a* to maintain a posture of the flapper as shown by the solid line.

Further, an inlet solenoid 3*d* is connected to one end of the link 3*b* so that, when the inlet solenoid 3*d* is turned ON, an iron core is attracted to rotate the inlet flapper 3 around the center shaft 3*a* in an anti-clockwise direction (FIG. 3) in opposition to a pulling force of the spring 3*c* to bring the flapper to a position shown by the broken line, to thereby achieve the book-bind mode. When the inlet solenoid 3*d* is turned OFF, the inlet flapper 3 is rotated around the center shaft 3*a* in the clockwise direction (FIG. 3) by the pulling force of the spring 3*c* to hold the flapper at a position shown by the solid line, to achieve the stack mode in which the sheet S is guided to the discharge guide 4.

A convey pulley 13*b* is secured to a center shaft 13*a* of the convey roller 13, and semi-circular roller pulleys 17*c*, 22*c* are secured to center shafts 17*a*, 22*b* of the semi-circular rollers 17*a*, 22*a*, respectively (refer to FIG. 3).

A convey motor pulley 52 is secured to an output shaft of a convey motor 51, and a timing belt 53 is mounted around the convey motor pulley 52, convey pulley 13*b* and semi-circular roller pulley 17*c*, and further, a timing belt 54 extends between the semi-circular roller pulleys 17*c* and 22*c*. The rotation of the convey motor 51 is transmitted from the convey motor pulley 52 to the timing belt 53 to rotate the convey pulley 13*b* and the semi-circular roller pulley 17*c* and further to rotate the semi-circular roller pulley 22*c* via the timing belt 54, to thereby rotate the convey roller 13 and the semi-circular rollers 17*a*, 22*a*.

Flapper links 15*b*, 16*b* are secured to rotation center shafts 15*a*, 16*a* of the switch flappers 15, 16, and the switch solenoids 15*d*, 16*d* are connected to one ends of the flapper links 15*b*, 16*b*, respectively. Springs 15*c*, 16*c* are connected to the other ends of the flapper links 15*b*, 16*b* so that the switch flappers 15, 16 are always biased by pulling forces of the springs 15*c*, 16*c* toward an anti-clockwise direction (FIG. 3) around the rotation center shafts 15*a*, 16*a* to maintain the switch flappers as shown in FIG. 3 (shown by the solid lines in FIG. 2).

When the switch solenoids 15*d*, 16*d* are turned ON, iron cores of the switch solenoids 15*d*, 16*d* are attracted to rotate the switch flappers 15, 16 around the rotation center shafts 15*a*, 16*a* the clockwise direction (FIG. 3) in opposition to the pulling forces of the springs 15*c*, 16*c* to bring the switch flappers to positions shown by the broken lines in FIG. 2.

Figure 4:
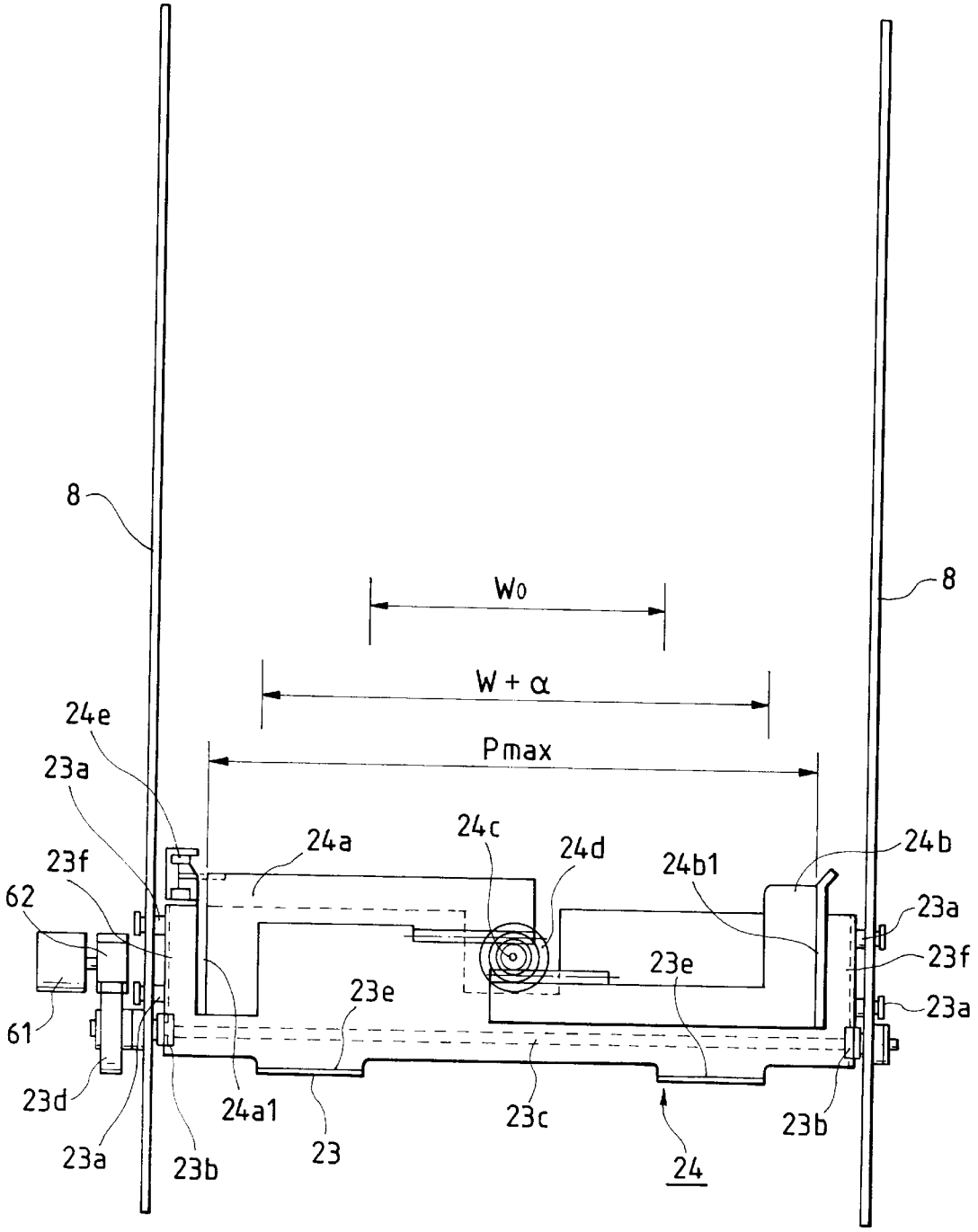
FIG. 4 is a front view showing a sheet lateral move portion and a sheet positioning portion of the sheet processing apparatus.

Next, the lateral move mechanism will be described with reference to FIG. 4. The lateral move members 24*a*, 24*b* have wall surfaces 24*a*1, 24*b*1 extending in parallel with the sheet conveying direction and protruded perpendicular to the surface of the sheet S at both lateral sides of the sheet and have opposed rack portions, and a pinion gear 24*c* disposed at a center between the wall surfaces is meshed with the rack portions.

The pinion gear 24*c* is secured to an output shaft of a lateral move motor (stepping motor) 24*d*. A lateral move home position sensor (photo-interrupter) 24*e* is disposed at a position where the sensor can detect a flag provided at an end of the lateral move member 24*a* when the lateral move members are retarded outwardly from a maximum sheet width position by about 5 to 10 mm.

Next, the sheet positioning mechanism will be described with reference to FIGS. 2 and 4. The sheet positioning member 23 has a wall surface 23*e* for catching the tip end of the sheet S entered between the sheet guides 20 and 21, which wall surface extends perpendicular to the sheet conveying direction and is protruded perpendicular to the surface of the sheet S at a position corresponding to the tip end of the sheet S. A plurality of rollers 23*a* are rotatably supported at both sides of the sheet positioning member 23. The rollers 23*a* are rotatably received in recessed portions formed (along the sheet conveying direction) in a pair of frames 8 arranged along the sheet conveying direction with a gap greater than a width of a maximum sheet S, so that the sheet positioning member 23 can be slid in the sheet conveying direction along the frames 8 by rotating the rollers 23*a* along the recessed portions.

Racks 23*f* extending in the sheet conveying direction are formed on both ends of the sheet positioning member 23, and pinion gears 23*b* secured to both ends of a rotary shaft 23*c* rotatably supported by the frames 8 are meshed with the racks 23*f* . Further, a sheet abut gear 23*d* is secured to one end of the rotary shaft 23*c*. A gear 62 secured to an output shaft of a sheet positioning motor (stepping motor) 61 is meshed with the sheet abut gear 23*d*.

The flag is formed at the end of the sheet positioning member 23. When the sheet positioning member 23 reaches the home position, the flag is detected by the home position sensor 63 (FIG. 2). A sheet tip end detect sensor 33 provided on the sheet positioning member 23 detects the fact that the tip end of the sheet S reaches the wall surface 23*e* of the sheet positioning member 23.

Figure 5:
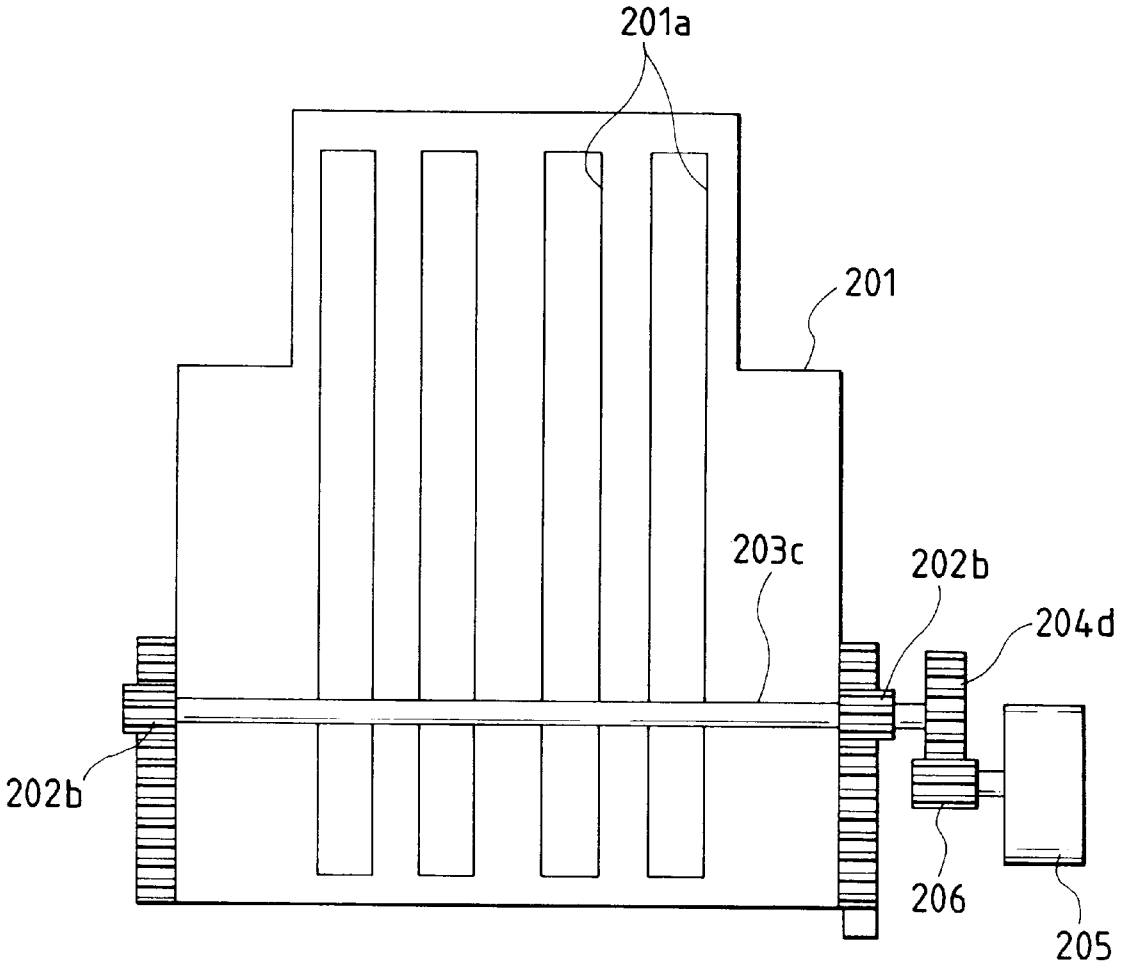
FIG. 5 is a front view showing a roller guide portion of the sheet processing apparatus.

Next, a drive mechanism for a roller guide will be explained with reference to FIGS. 2 and 5. In FIGS. 2 and 5, a roller guide 201 blocks the sheet S so that the sheet entered between the sheet guides 20 and 21 does not enter into the convey path at the pair of fold rollers 26, 27.

As shown in FIG. 5, a plurality of elongated slots 201*a* are formed in the roller guide 201 not to interfere with the semi-circular roller 22*a* and the sheet positioning member 23. Racks are formed on both ends of the roller guide 201 along the sheet conveying direction, and pinion gears 202*b* secured to both ends of a rotary shaft 203*c* ratatably supported by frames (not shown) are engaged by the racks. A roller guide gear 204*d* is secured to one end of the rotary shaft 203*c* and a gear 206 secured to an output shaft of a roller guide motor (stepping motor) 205 is meshed with the roller guide gear 204*d*.

A flag is formed on one end of the roller guide 201. When the roller guide 201 reaches the home position, the flag is detected by a roller guide home position sensor 207 (FIG. 2).

Figure 6:
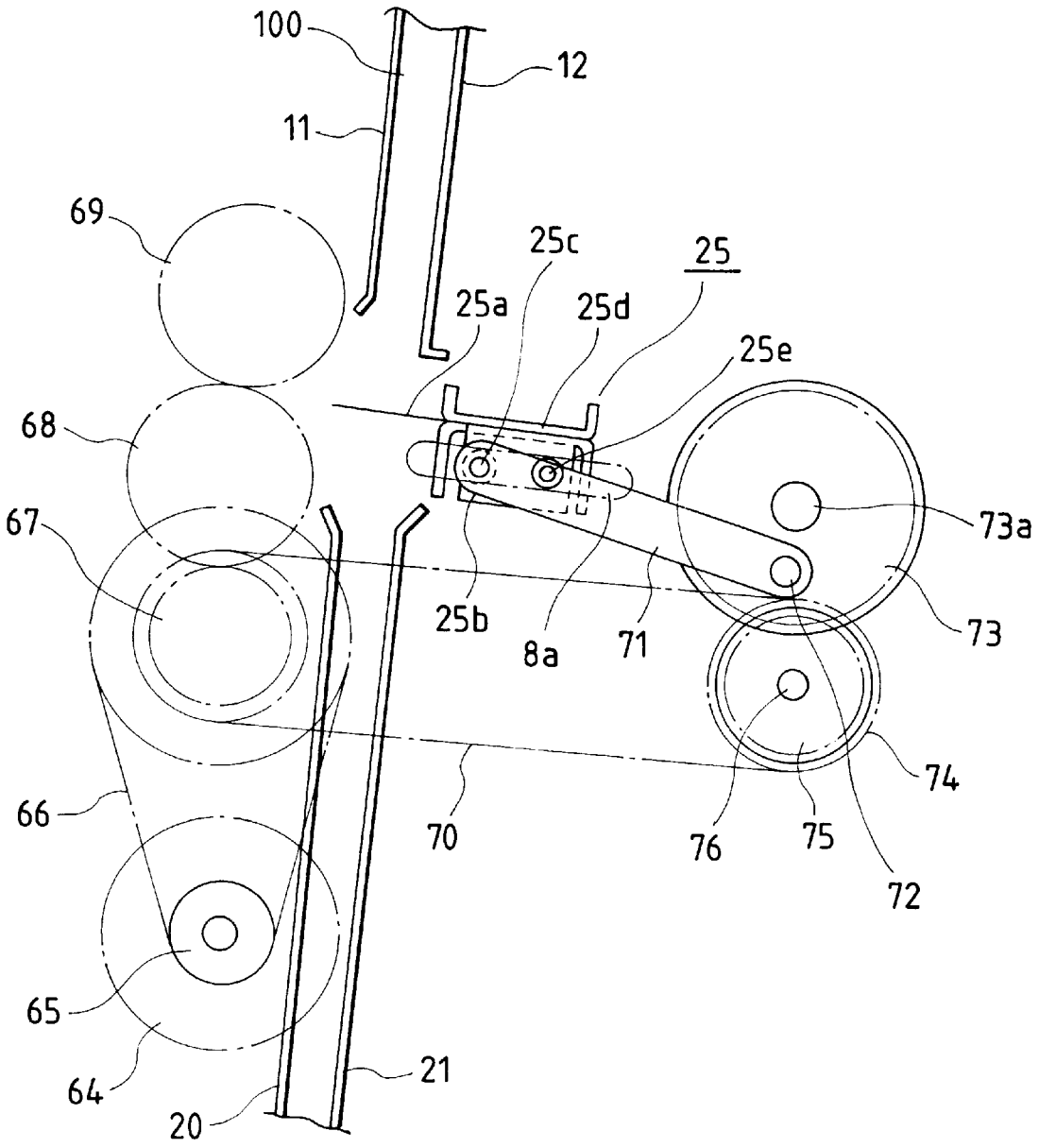
FIG. 6 is an explanatory view showing a protrude unit portion and a fold roller portion of the sheet processing apparatus.
Figure 7:
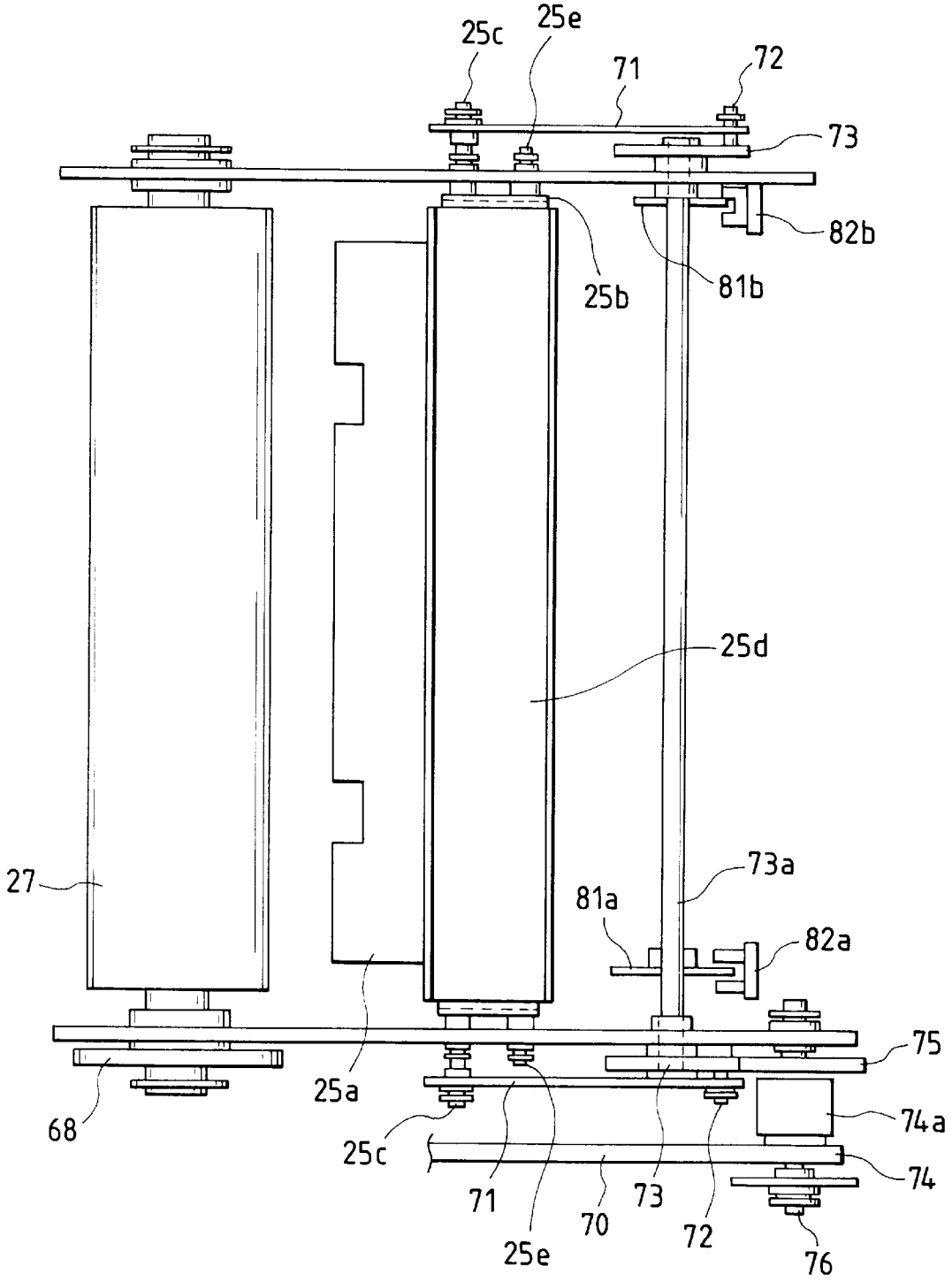
FIG. 7 is a plan view showing the protrude unit portion and the fold roller portion of the sheet processing apparatus.

Next, a drive mechanism for the folding means will be explained with reference to FIGS. 2, 6 and 7. In FIG. 6, a motor pulley 65 is secured to an output shaft of a fold motor 64. In an idler gear pulley 67, a pulley and a gear are coaxially formed. A timing belt 66 extends between the pulley of the idler gear pulley 67 and the motor pulley 65.

Fold gears 68, 69 are secured to the pair of fold rollers 26, 27, respectively and are meshed with each other, and one end of the fold gear 68 is engaged by the gear of the idler gear pulley 67. A protrude plate 25*a* provided on the protrude unit 25 abuts against a right side surface (FIG. 6) of a substantially central portion of the sheet S or the sheet bundle S to push the sheet or sheet bundle to the left (FIG. 6), so that the substantially central portion of the sheet S or the sheet bundle S is shifted in the vicinity of the nip between the pair of fold rollers 26, 27 and then is entered into the nip while being folded. To this end, the protrude plate is formed from a stainless plate having a thickness of about 0.5 mm.

The protrude plate 25*a* is held by holders 25*b*, 25*d*. Shafts 25*c*, 25*e* are secured to the holder 25*b*, and rollers are rotatably mounted on the shafts 25*c*, 25*e*. The rollers are shifted in the recessed portions 8*a* formed in the frames 8 shown in FIG. 4 while being rotated, so that the protrude unit 25 can be slid along the recessed portions 8*a*.

A gear is meshed with an idler gear 75 and is provided at its one side with a shaft 72. The idler gear 75 is secured to a shaft 76, and a fold clutch (electromagnetic clutch) 74*a* is provided on the shaft 76. By turning ON or OFF the fold clutch 74*a*, rotation of the pulley is transmitted or not transmitted to the shaft 76.

A timing belt 70 is mounted on the pulley 74 and the pulley of the idler gear pulley 67. The idler gear 75 secured to the shaft 76 is meshed with a gear 73 secured to a shaft 73*a*, and flags 81*a*, 81*b* each having a notch are secured to the shaft 73*a*. A protrude plate home position sensor 82*a* is disposed to detect the notch of the flag 81*a* so that the notch is detected at a position where the protrude plate 25*a* is retracted from the convey surfaces of the sheet guides 20, 21.

A protrude plate tip end sensor 82*b* is disposed to detect the notch of the flag 81*b* so that a position where the protrude plate 25*a* most approaches the nip between the pair of fold rollers 26, 27 is detected. The rotation of the fold motor 64 is transmitted from the motor pulley 65 to the idler gear pulley 67 through the timing belt 66. The rotation of the idler gear pulley 67 is transmitted from the fold gear 68 to the fold gear 69, to thereby rotate the pair of fold rollers 26, 27.

On the other hand, the rotation of the idler gear pulley 67 is transmitted to the pulley 74 of the fold clutch 74*a* through the timing belt 70. When the fold clutch 74*a* is turned ON, the rotation of the pulley 74 is transmitted to the shaft 76 to rotate the idler gear 75, so that the gear 73 is rotated to revolve the shaft 72 around the shaft 73*a*.

A link 71 having one end connected to the shaft 72 is connected to the shaft 25*c* at its other end. The shaft 25*c* is secured to the protrude unit 25 and is received in the recessed portions 8*a* of the frames 8 via the rollers. Thus, the protrude unit is shifted linearly. Due to this linear movement, the protrude plate 25*a* provided on the protrude unit 25 can be shifted linearly between the protrude position and the retard position.

Next, a drive mechanism for the stack discharge roller 5 will be explained with reference to FIGS. 2 and 3. A shaft 5*a* to which the stack discharge roller 5 is secured is provided at an upper part of the finishing apparatus 2, and a pulley 98 is secured to the shaft 5*a*. A pulley 96 is secured to an output shaft of a stack discharge motor 95. A timing belt 97 is mounted between the pulley 96 and the pulley 98 so that the rotation of the stack discharge motor 95 is transmitted from the pulley 96 to the pulley 98 through the timing belt 97, to thereby rotate the stack discharge roller 5 through the shaft 5*a*.

The stack discharge motor is constituted by a stepping motor, and a peripheral speed of the stack discharge roller 5 is set to be greater than a peripheral speed of the discharge roller 1*a*. Since a conveying force of the discharge roller 1*a* is set to be greater than a conveying force of the pair of stack discharge rollers 5, 6, while the sheet is being pinched between the discharge rollers 1*a*, 1*b*, the sheet is slipped between the paired stack discharge rollers 5 and 6, and, when the sheet leaves the pair of discharge rollers 1*a*, 1*b*, the sheet is conveyed by the conveying force of the pair of stack discharge rollers 5, 6.

Next, the control system of the finishing apparatus 2 as the sheet processing apparatus according to the present invention will be explained with reference to FIG. 8. The control device (CPU) 150 including the switch-back control means is a main part of an input/output (I/O) device.

An inlet sensor (detect means) 83 for detecting the fact that the sheet S discharged from the image forming apparatus 1 enters into the finishing apparatus 2, a sheet tip end detect sensor 33 for transmitting to the CPU 150 the fact that the sheet S reaches a predetermined position in the finishing apparatus 2, and a discharge sensor 29 for detecting the fact that the sheet S is discharged onto a discharge tray (second sheet containing means) 29 are connected to an input side of the CPU 150.

Further, a fold roller CLK sensor 216 for transmitting rotation speed control of the pair of fold rollers 26, 27 to the CPU 150, a roller guide home position sensor (roller guide H.P sensor) 207 for detecting the home position of the roller guide 201, a sheet positioning home position sensor (sheet positioning H.P sensor) 63 for detecting the home position of the sheet positioning member 23 for aligning the tip ends of the sheets S, a lateral move home position sensor (lateral move H.P sensor) 24*e* for detecting the home positions of the lateral move members 24*a*, 24*b* for aligning the sheets in the lateral direction, and a protrude plate home position sensor (protrude plate H.P sensor) 82*a* for detecting the home position of the protrude plate 25*a* are connected to the input side of the CPU 150.

Further, a semi-circular roller sensor 217 for detecting the rotational positions of the semi-circular rollers 17*a*, 22*a*, a tray limit sensor 218 for detecting over-stack of the sheets S stacked on the stack tray 7 and the discharge tray 32, a first door switch 219 for detecting opening/closing of a door for jam treatment, and second door switch 220 for detecting opening/closing of a door for replenishing or exchanging the staple needles in the staple unit 18 are connected to the input side of the CPU 150.

Further, a first staple needle presence sensor (needle presence/absence detect means) 212 for detecting presence/absence of the staple needle in a first stapler unit 18' among the plurality of stapler units 18, a first staple motor home position sensor (staple motor H.P sensor) 211 for detecting a stapling waiting position of the staple portion, a second staple needle presence sensor (needle presence/absence detect means) 215 for detecting presence/absence of the staple needle in a second stapler unit 18", and a second staple motor home position sensor (staple motor H.P sensor) 214 for detecting a stapling waiting position of the staple portion are connected to the input side of the CPU 150.

Further, a sheet thickness detect sensor 230 (described later) for detecting a thickness of the sheet bundle conveyed and discharged from the image forming apparatus 1 is connected to the input side of the CPU 150. On the other hand, a convey motor 51 for conveying the sheet S in the finishing apparatus 2 is connected to an output side of the CPU 150 via a driver D1; a roller guide motor 205 for driving the roller guide 201 for guiding the sheet S in the finishing apparatus 2 from the pair of fold rollers 26, 27 is connected to the output side of the CPU 150 via a driver D2; a sheet positioning motor 61 for holding the sheet S in the finishing apparatus 2 at a predetermined position is connected to the output side of the CPU 150 via a driver D3; and a lateral move motor 24*d* for aligning the sheets S in the finishing apparatus 2 in the lateral direction is connected to the output side of the CPU 150 via a driver D4.

Further, a fold motor 64 for folding the sheet S or the sheet bundle S in the finishing apparatus 2 is connected to the output side of the CPU 150 via a driver D5; a fold clutch 74*a* for operating the protrude plate 25*a* is connected to the output side of the CPU 150 via a driver D6; switch solenoids 15*d*, 16*d* for operating the switch flappers 15, 16 for switching the convey path in the finishing apparatus 2 are connected to the output side of the CPU 150 via drivers D7, D8; and first and second staple motor 210, 213 for driving the first and second stapler units 18', 18" to staple the sheet bundle are connected to output side of the CPU 150 via drivers D9, D10.

A read only memory (ROM) 152 previously stores control sequence carried out by the CPU 150. A random access memory (RAM) 153 is a memory means for storing various data such as calculation data of the CPU 150 and control data received from the image forming apparatus 1.

Figure 9:
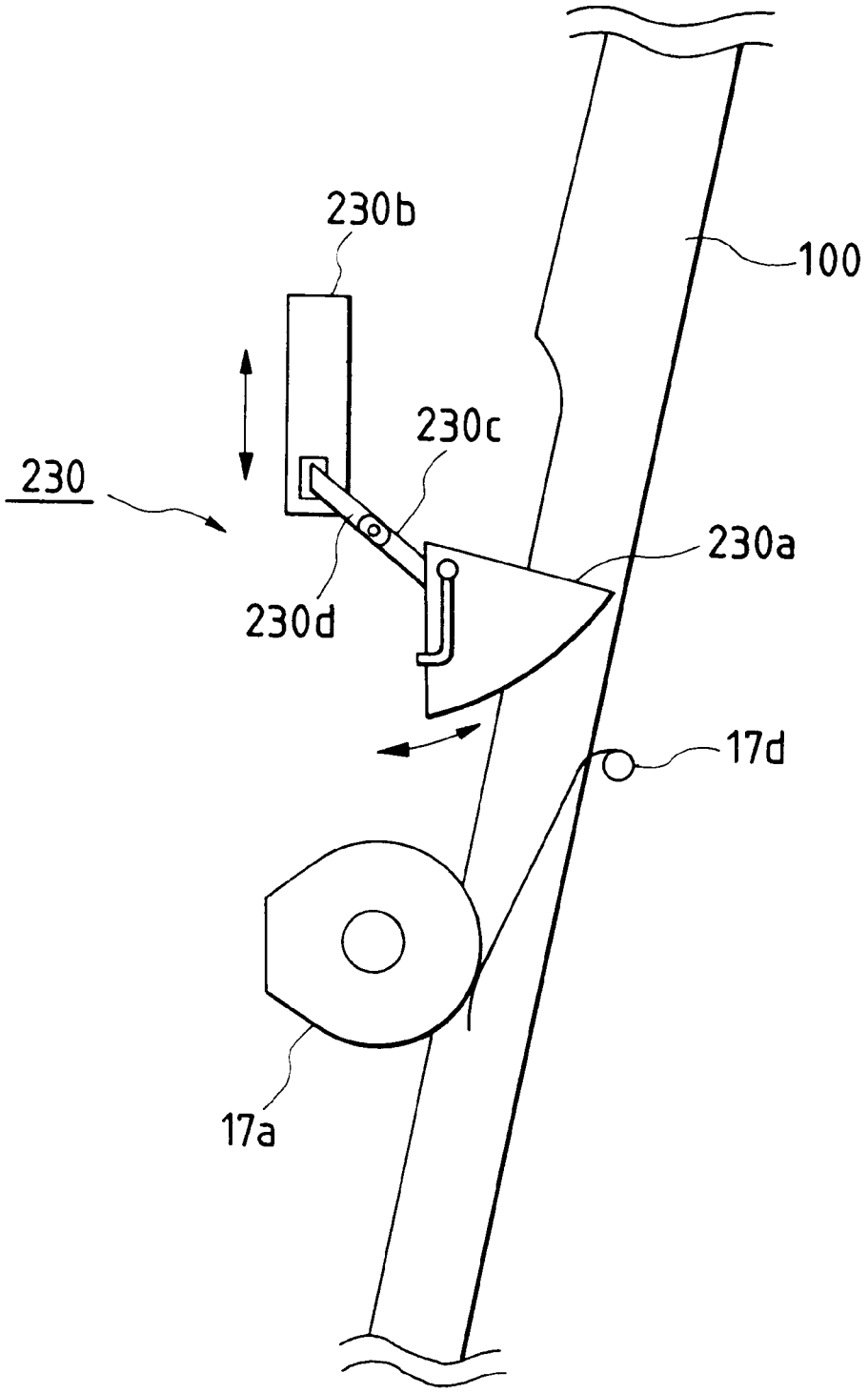
FIG. 9 is a side view showing sheet thickness detect portion of the sheet processing apparatus.

Next, the sheet thickness detect sensor 230 will be described with reference to FIG. 9. In FIG. 9, the sheet thickness detect sensor 230 is disposed upstream of the semi-circular roller 17*a* and back-up spring (elastic member) 17*d* and comprises a shaft 230*c* for rockably supporting a flag 230*a*, and slide volume 230*b* for detecting an absolute position of the flag 230*a*.

When the flag 230*a* is pushed up by the sheet S passe through the convey path 100, the flag is rocked around the shaft 230*c* to shift the slide volume 230*b* via an arm 230*d*, so that a resistance value of the slide volume 230*b* is changed, to thereby output an analogue signal to the CPU 150. In this way, a thickness of the sheet S or the sheet bundle contained or stacked in the convey path 100 is detected.

Figure 10:
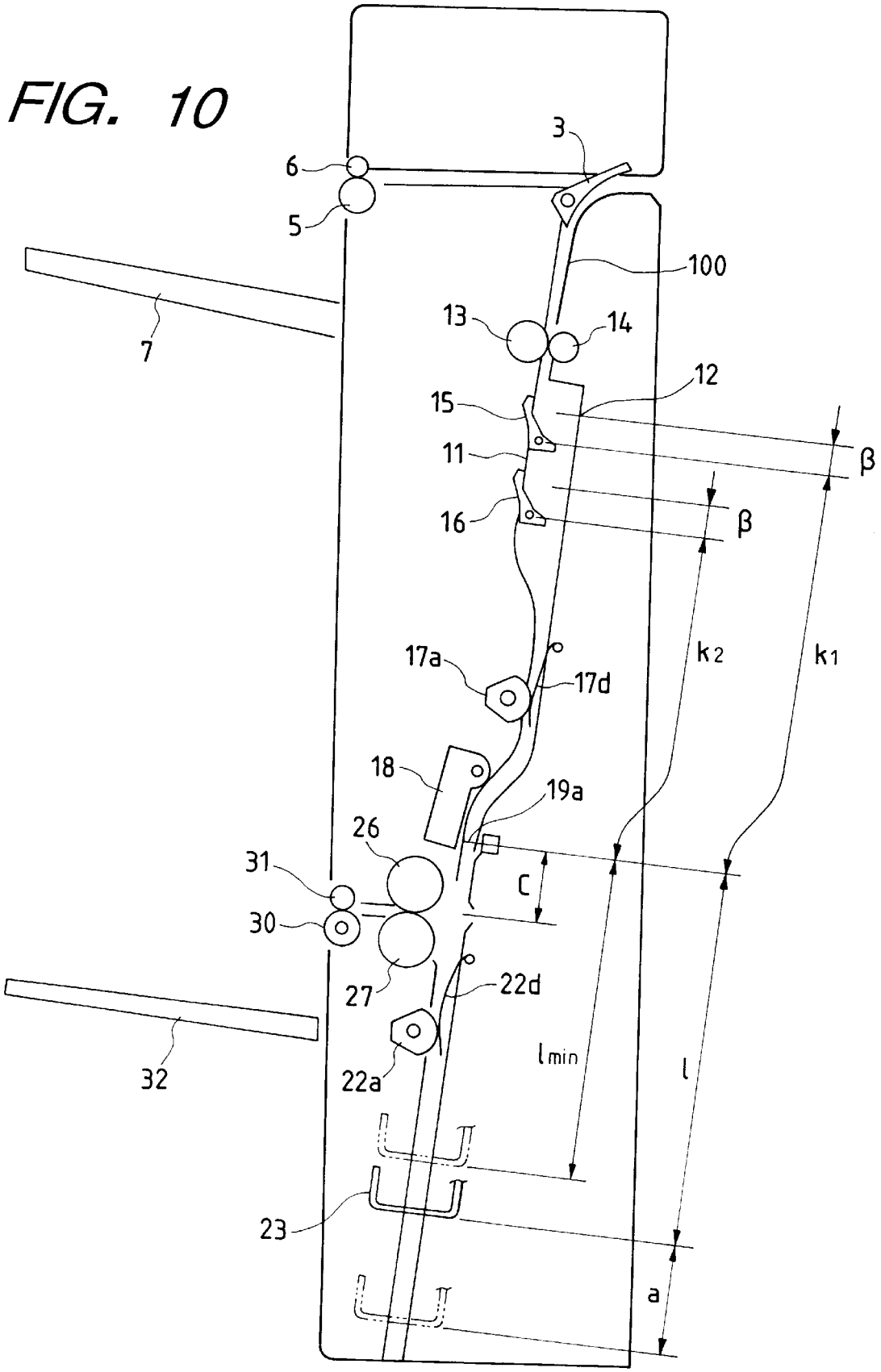
FIG. 10 is a view showing main dimensions of a sheet positioning portion of the sheet processing apparatus.
Figure 11:
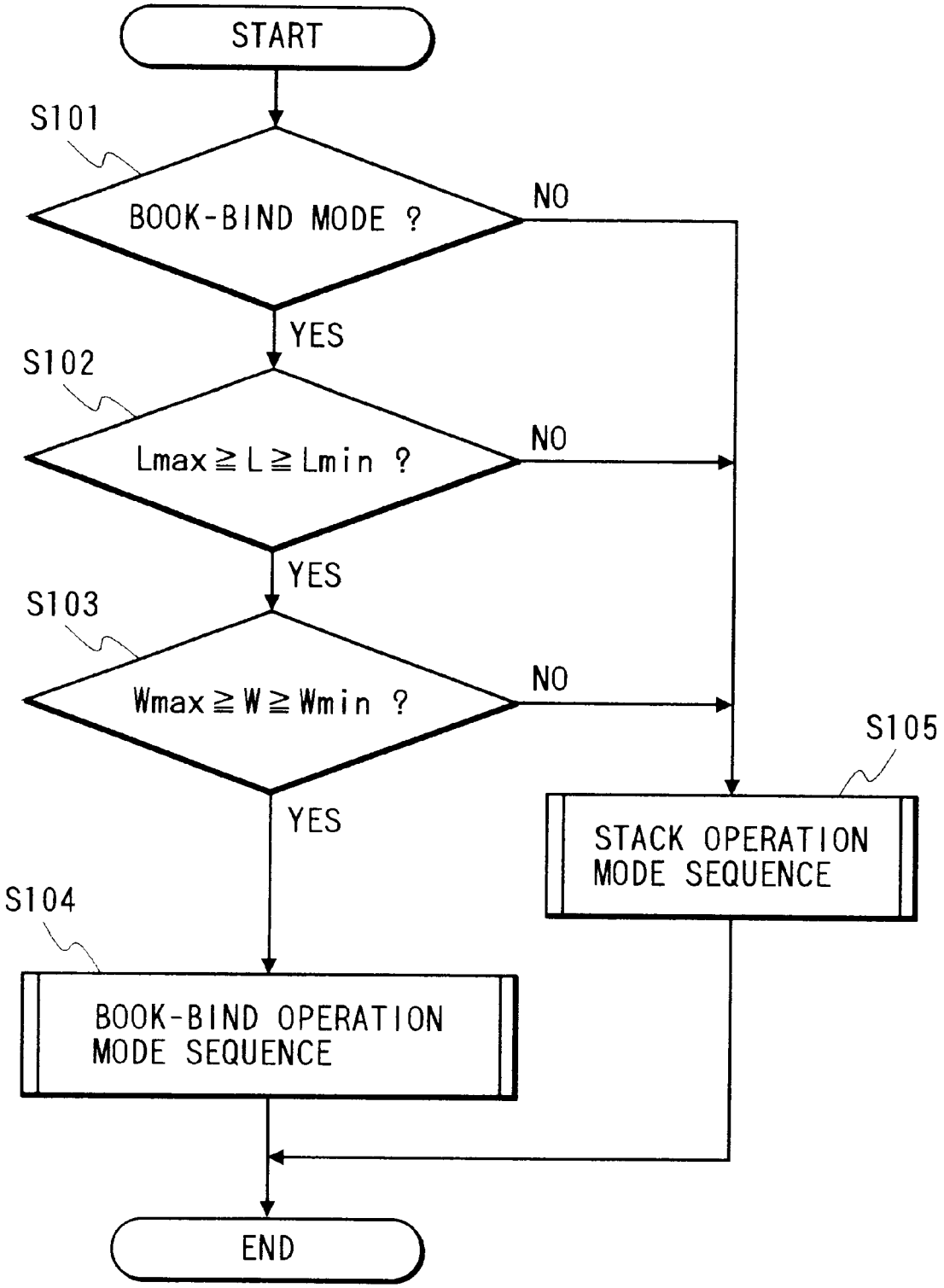
FIG. 11 is a main flow chart showing a bookbinding mode of the sheet processing apparatus.
Figure 12A:
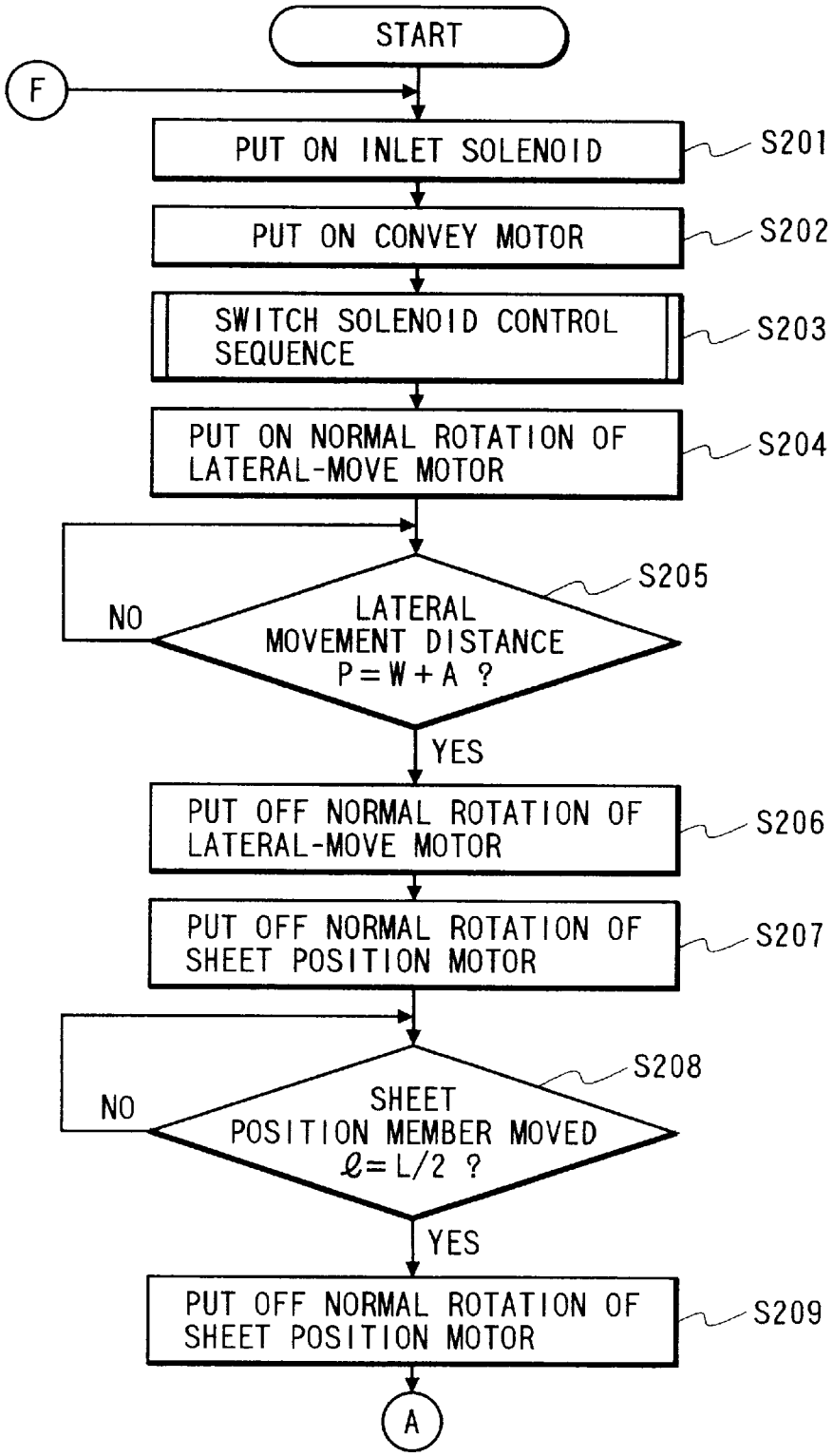
FIGS. 12A, 12B, 12C, 13, 14A, 14B, 14C, 15A and 15B are flow charts showing an operation of the sheet processing apparatus.
Figure 12B:
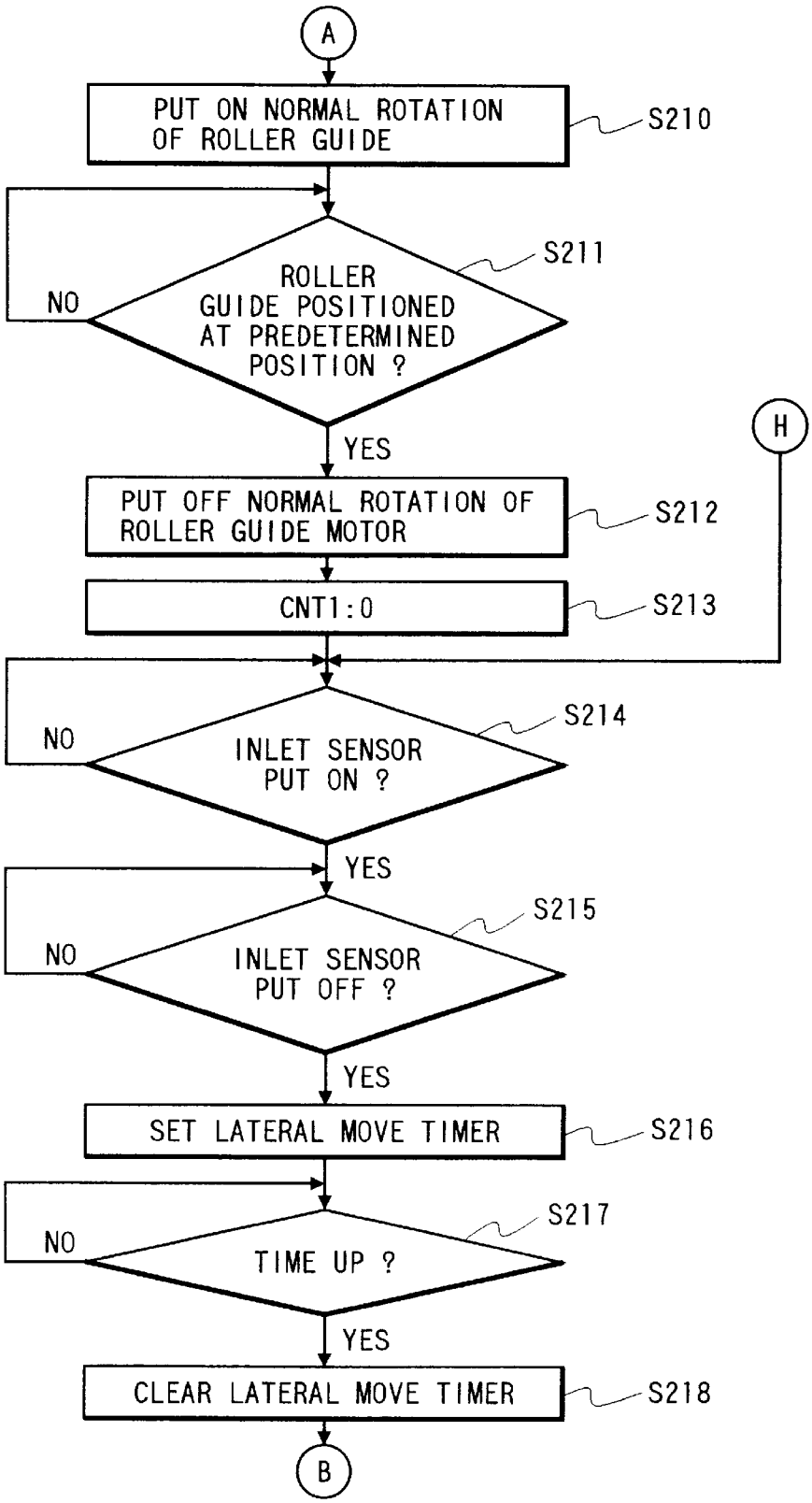
Figure 12C:
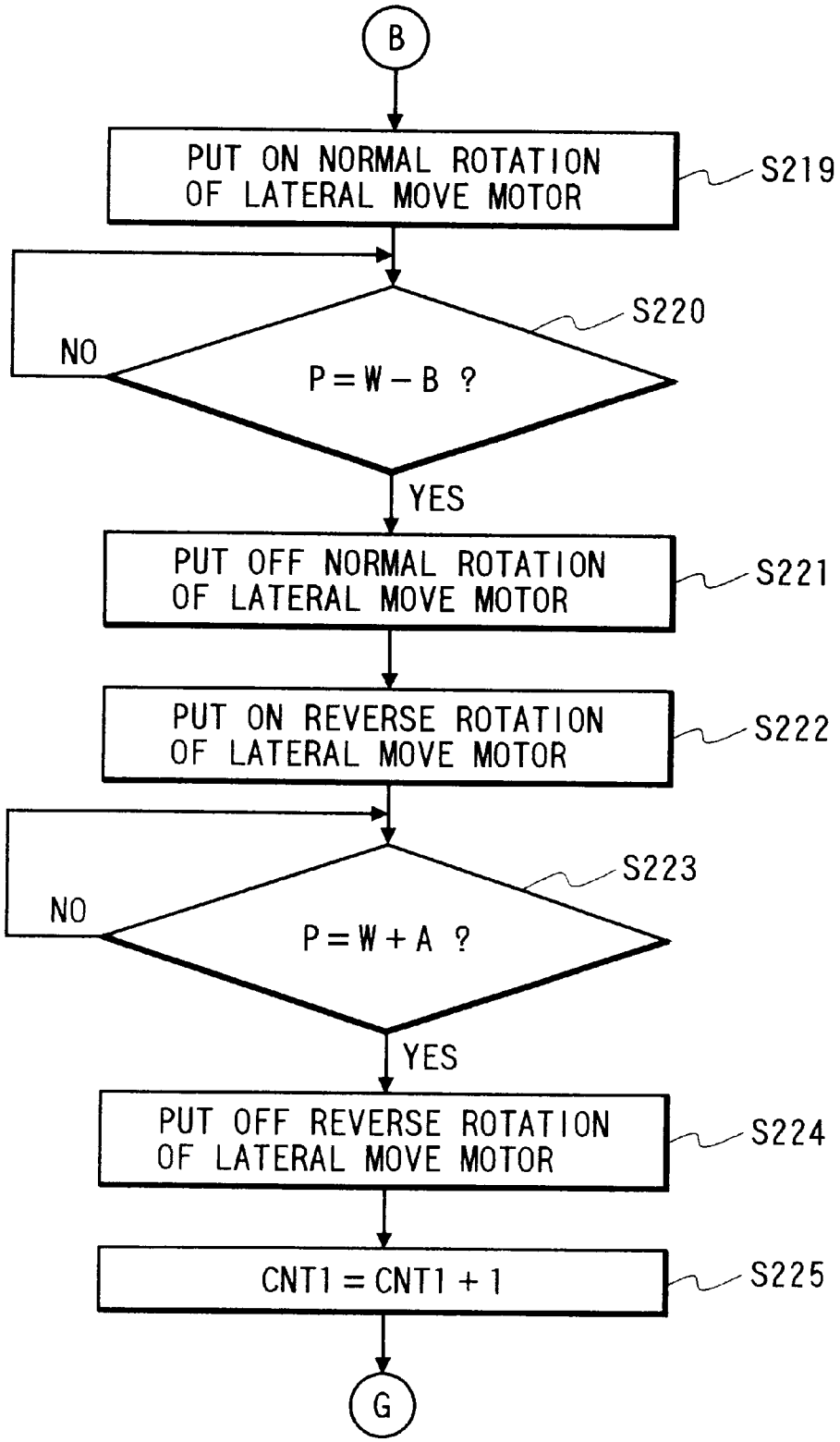
Figure 13:
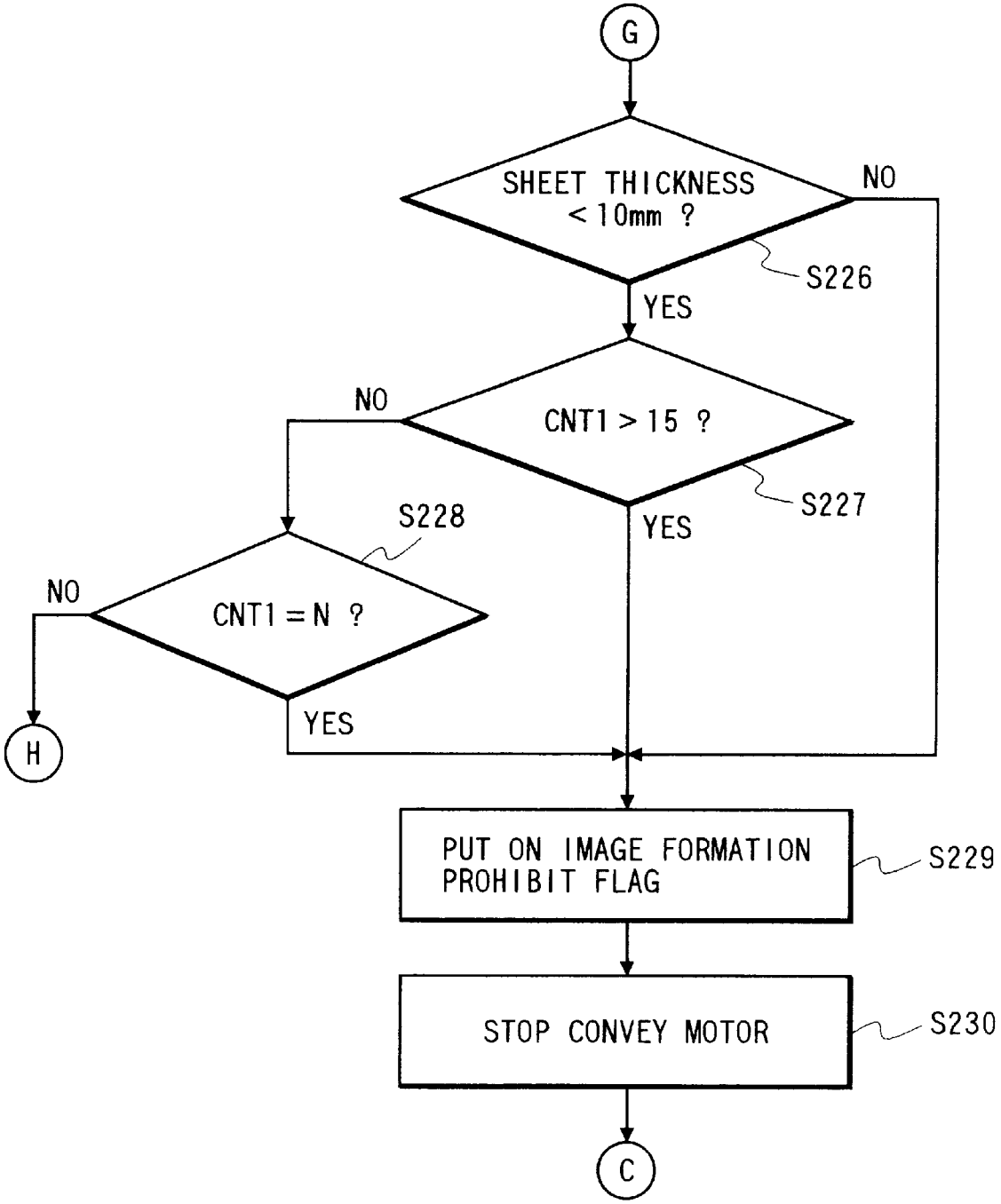
Figure 14A:
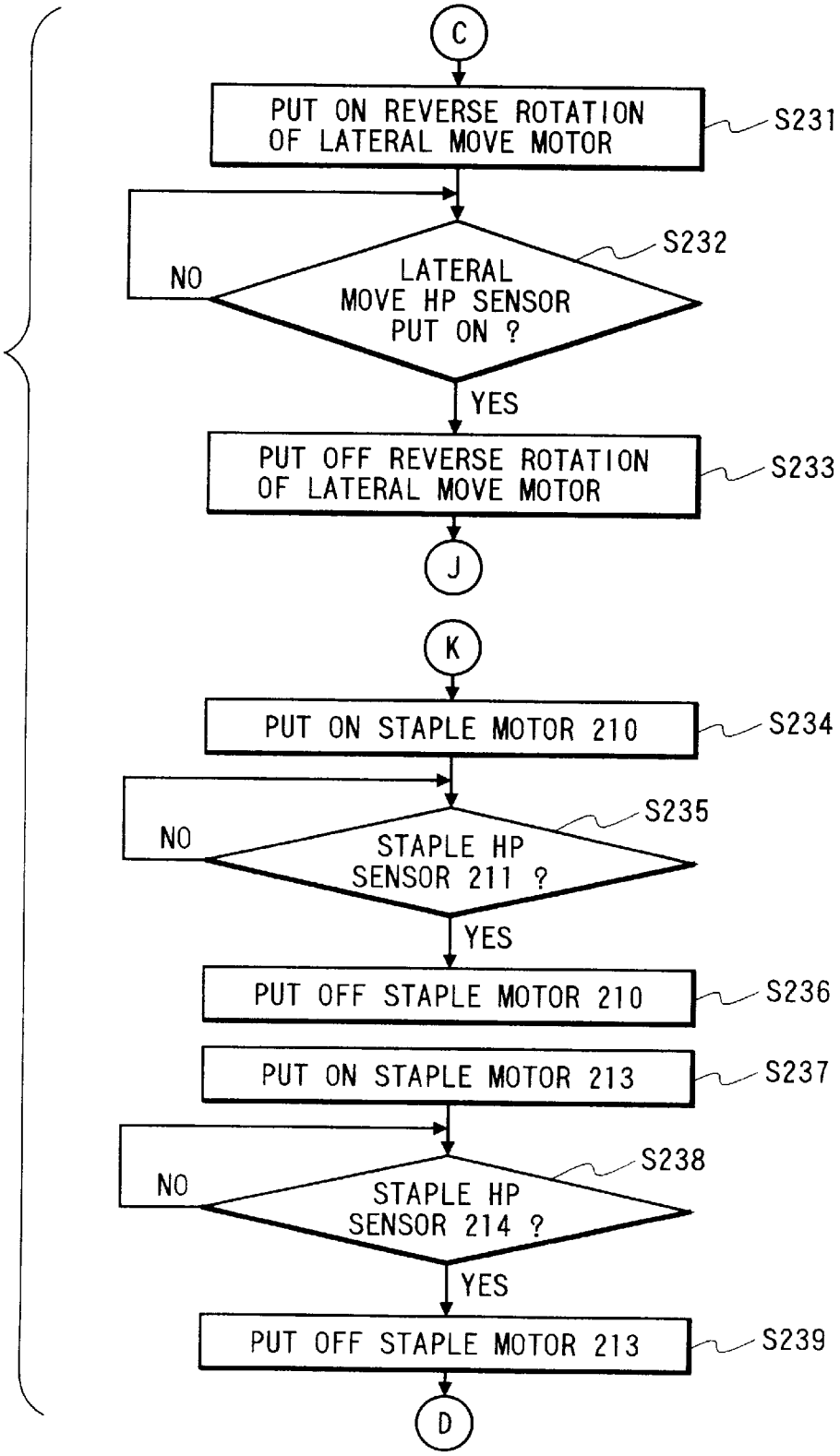
Figure 14B:
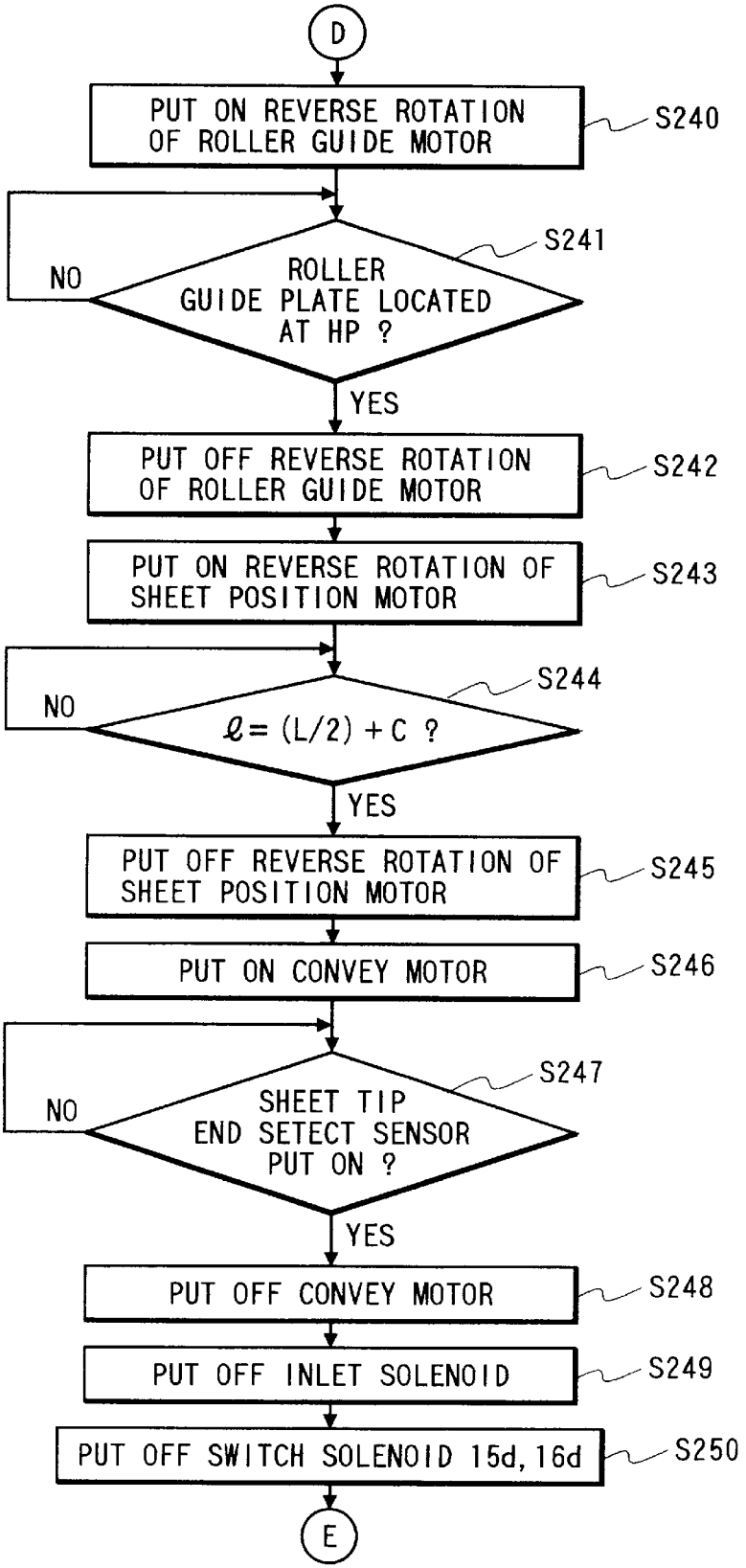
Figure 14C:
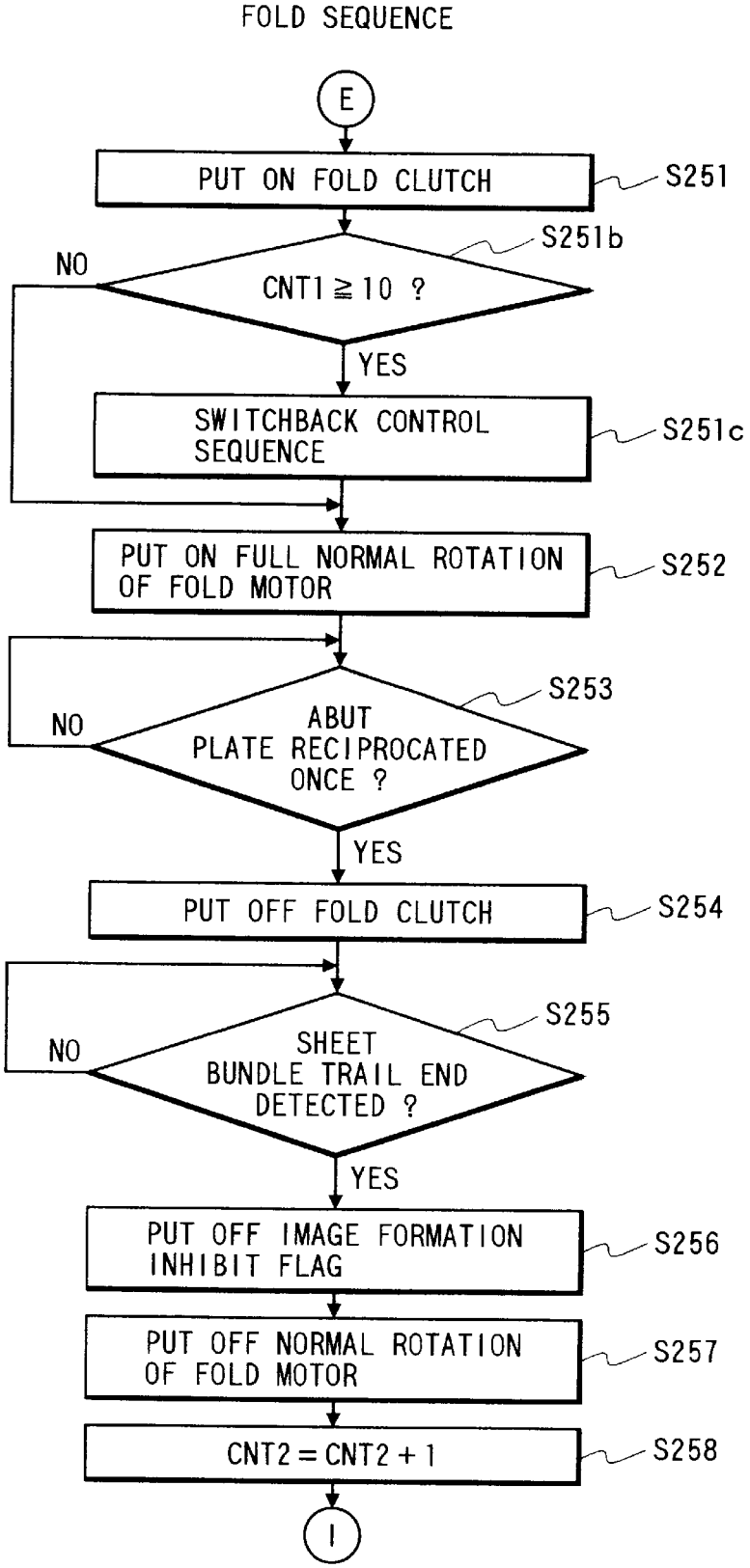

Next, control of the finishing apparatus 2 as the sheet processing apparatus according to the present invention will be explained with reference to FIG. 10 (showing a dimensional relation of the convey path in the finishing apparatus 2) and FIGS. 11, 12A to 12C, 13, 14A to 14C, 15A and 15B, 16, 17, 18A and 18B (showing flow charts). FIG. 11 shows a main routine which starts the operation of the finishing apparatus 2 when size information (length L (in the sheet conveying direction) of the sheet S discharged from the image forming apparatus 1 to which the finishing apparatus 2 is connected, and a length (width) W of the sheet S in a direction perpendicular to the sheet conveying direction), the number of sheets information N and part information M are received and a start signal is received.

Thereafter, mode information is ascertained (step S101). If there is no book-bind mode, the program goes to a stack mode (step S105); whereas, if there is the book-bind mode, it is ascertained whether the length L and the width W permits the book-binding or not (steps S102, S103). If the size L, W do not permit the book-binding, the program goes to the stack mode (step S105). If the size L, W permits the book-binding, the program goes to a step S104, where a book-bind operation mode sequence is performed.

Next, the book-bind mode sequence will be explained with reference to FIGS. 12A to 12C, 13, 14A to 14C, 15A and 15B and 16. First of all, if it is judged that the size permits the book-binding, the program goes to a step S201 in FIG. 12A, where the inlet solenoid 3*d* is turned ON to open the convey path 100 for the book-bind mode. After the convey motor 51 is turned ON to rotate the pair of convey rollers 13, 14 and the semi-circular rollers 17*a*, 22*a* for permitting the conveyance of the sheet S (step S202), the program goes to a step S203, where the switch solenoids 15*d*, 16*d* are driven to control the switch flappers 15, 16.

Then, the lateral move motor 24*d* is turned ON to rotate it in the normal direction (step S204) so that a distance P between the lateral move members 24*a* and 24*b* becomes (W+A) (where, A is a gap between the sheet size and the lateral move members 24*a*, 24*b*; normally, A is about 10 mm). The lateral move motor 24*d* continues to be driven until the distance P between the lateral move members 24*a* and 24*b* becomes (W+A). When the distance between the lateral move members 24*a* and 24*b* becomes (W+A), the normal rotation of the lateral move members 24*a* is turned OFF (step S206).

Then, the sheet positioning motor 61 is turned ON to rotate it in the normal direction until the sheet positioning member 23 reaches a position downstream from the staple position 19*a* of the stapler unit 18 by a distance l=L/2 (refer to FIG. 10) (steps S207, S208). At the time when the sheet positioning member 23 reaches the position at the downstream side from the staple position 19*a* of the stapler unit 18 by the distance l=L/2, the normal rotation of the sheet positioning motor 61 is turned OFF (step S209).

At the same time, the roller guide motor 205 is turned ON to rotate it in the normal direction thereby to shift the roller guide 201 to a predetermined position where the pair of fold rollers 26, 27 are covered, in order to prevent the sheet S being conveyed from striking against the pair of fold rollers 26, 27 (steps S210, S211). When the roller guide 201 is shifted from the home position to the predetermined position, the normal rotation of the roller guide motor is turned OFF.

Then, the sheet number counter CNT1 is set to "0" (step S213), and a signal of the inlet sensor 83 is ascertained (step S214). When the inlet sensor 83 is changed from ON to OFF (step S215), a lateral move timer is set on the basis of the sheet size information so that, after a time period t1 during which the tip end of the sheet S abuts against the sheet positioning member 23 is elapsed, the sheets S are aligned (step S216).

When the lateral move timer is timed up (step S217), the program goes to a step S218, where the lateral move timer is cleared. Thereafter, the lateral move motor is turned ON to rotate it in the normal direction (step S219) to thereby shift the lateral move members 24*a*, 24*b* to a position where the distance P between the lateral move members 24*a* and 24*b* becomes (W−B) (where, B is an amount that the sheet S is pushed in by the lateral move members 24*a*, 24*b*; normally, A is about 10 mm).

The normal rotation of the lateral move motor 24*d* is continued until the distance P becomes (W−B) (step S220). When P=W−B is attained, the normal rotation of the lateral move motor 24*d* is turned OFF (step S221).

Then, once the lateral movement is carried out, the lateral move motor 24*d* is turned ON to rotate it in the reverse rotation to thereby shift the lateral move members 24*a*, 24*d* to the position where P=(W+A) is attained for providing the waiting condition for the next sheet S (steps S222 to S224). The steps S219 to S224 are performed within a short time period during which the semi-circular rollers 17*a*, 22*a* do not abut against the back-up springs (elastic members) 17*d*, 22*d*.

"1" is added to the sheet number counter CNT1 (step S225), and, the program goes to a step S226 where it is judged whether the thickness of the sheet bundle S is more than 10 mm (staple permitting thickness). If the thickness is more than 10 mm, the program goes to a step S229, where an image formation prohibit flag is turned ON to prohibit the operation of the image forming apparatus 1, and goes to the folding operation with bypassing the stapling operation.

The thickness of the sheet bundle S is detected by the sheet thickness detect sensor 230 shown in FIG. 8. If the thickness of the sheet bundle S is smaller than 10 mm, the program goes to a step S227, where it is judged whether the counted number of the sheet number counter CNT1 is greater than 15 (staple permitting number). If more than 15, the program goes to the step S229, where the image formation prohibit flag is turned ON to prohibit the operation of the image forming apparatus 1. This provides dual safety system on the basis of the sheet thickness and sheet number.

However, if the counted number of the sheet number counter CNT1 is smaller than 15 and if desired discharge sheet number is not attained in the step S228, the above operations are repeated until the desired discharge sheet number is attained. If the desired number of discharge sheet is recognized in the step S228, the program goes to the step S229, where the image formation prohibit flag is turned ON to prohibit the operation of the image forming apparatus 1.

Then, the program goes to a step S230, where the convey motor 51 is turned OFF to stop the conveyance of the sheet S. Then, an operation for returning the lateral move member 24*a*, 24*b* to the home position is effected. That is to say, the lateral move motor 24*d* is turned ON to rotate it in the reverse direction (step S231) until the lateral move member 24*a*, 24*b* are returned to the home position (step S232).

In the step S232, if the fact that the lateral move member 24*a*, 24*b* are returned to the home position is detected, the program goes to a step S233, where the reverse rotation of the lateral move motor 24*d* is turned OFF. In the step S233, when the reverse rotation of the lateral move motor 24*d* is turned OFF, the program goes to a step S265 shown in FIG. 15A, where the presence or absence of the staple needle in the stapler unit 18' is judged. If there is no staple needle, the program goes to a step S267, where an image formation prohibit flag is turned ON, to thereby prohibit the stapling operation, folding operation and image forming operation.

Then, the program goes to a step S268, where a waiting condition is continued until the staple needles are replenished in the stapler unit 18' (to provide a staple needle presence condition). If the staple needle presence condition is attained, the program goes to a step S269, where the presence or absence of the staple needle in the stapler unit 18" is judged. If there is any staple needle(s), the program goes to a step S270, where the image formation prohibit flag is turned OFF, and, then, the program goes to a step S234 shown in FIG. 14A to effect the stapling operation and the folding operation.

However, in the step S265, if it is judged that any staple needle(s) are remaining in the stapler unit 18', the program goes to a step S266, where, similar to the step S265, the presence or absence of the staple needle in the stapler unit 18" is judged. If it is judged that any staple needle(s) are also remaining in the stapler unit 18", the program goes to the step S234 shown in FIG. 14A to effect the stapling operation and the folding operation.

Since the stapling operation and folding operation mode is selected, as shown in steps S234 to S239, by using the stapler units 18', 18", the stapling operation with two points staple is performed to bundle a plurality of sheets S.

Then, the program goes to a step S240, where the roller guide motor 205 is turned ON to rotate it in the reverse direction (step S240) to thereby return the roller guide 201 to the home position for preparing for the folding operation. The reverse rotation of the roller guide motor 205 is continued until the roller guide 201 is returned to the home position (step S241). In the step S241, the fact that the roller guide 201 is returned to the home position is detected, the program goes to a step S242, where the reverse rotation of the roller guide motor 205 is turned OFF (step S242). Then, the sheet positioning motor 61 is turned ON to rotate it in the reverse direction so that the sheet positioning member 23 reaches a position downstream from the staple position 19*a* by a distance l=(L/2)+C (where, C is a distance between the staple position 19*a* and a folding position; refer to FIG. 10) (step S243).

The reverse rotation of the sheet positioning motor 61 is continued until the sheet positioning member 23 is shifted to the predetermined position (step S244). In the step S244, the fact that the sheet positioning member 23 is shifted to the predetermined position is detected, the program goes to a step S245, where the reverse rotation of the sheet positioning motor 61 is turned OFF.

Then, the convey motor 51 is driven again to convey the sheet bundle until the sheet bundle abuts against the sheet positioning member 23 (step S264). The driving of the convey motor 51 is continued until the sheet bundle is conveyed to the predetermined position (step S247). In the step S247, the fact that the tip end of the sheet bundle abuts against the sheet positioning member 23 is detected, the convey motor 51 is turned OFF (step S248), and the inlet solenoid 3*d* and the switch solenoids 15*d*, 16*d* are turned OFF (steps S249, S250).

Then, the fold clutch 74*a* is turned ON (step S251) and then, it is judged whether the counted number of the sheet number counter CNT1 is greater than 10 (step S251*b* ). If the counted number of the sheet number counter CNT1 is greater than 10, the program goes to a switch-back control sequence (step S251*c* ) which will be described later. On the other hand, in the step S251*b*, if the counted number of the sheet number counter CNT1 is smaller than 10, the program goes to a step S252, where the fold motor 64 is turned ON. Now, the case where the counted number of the sheet number counter CNT1 is smaller than 10 will be explained.

When the fold motor 64 is turned ON, the protrude plate 25*a* start to be protruded to guide the sheet bundle (in a pre-folded condition) to the nip of the pair of fold rollers 26, 27. The fold clutch continues to be turned ON until the fact that the protrude plate 25*a* performs one reciprocation is detected by the protrude plate home position sensor 82*a* (step S253).

In the step S253, if fact that the protrude plate 25*a* performs one reciprocation is detected by the protrude plate home position sensor 82*a*, the fold clutch 74*a* is turned OFF (step S254). Then, the fold motor 64 continues to be turned ON until the trail end of the sheet bundle is detected by the discharge sensor 29, in order to convey the sheet bundle by the pair of fold rollers 26, 27 (step S255). In the step S255, if the trail end of the sheet bundle is detected by the discharge sensor 29, the program goes to a step S256, where the image formation prohibit flag (set in the step S229) is turned OFF to release the prohibition of the image forming operation, and then, the fold motor 64 is turned OFF (step S257).

Figure 15A:
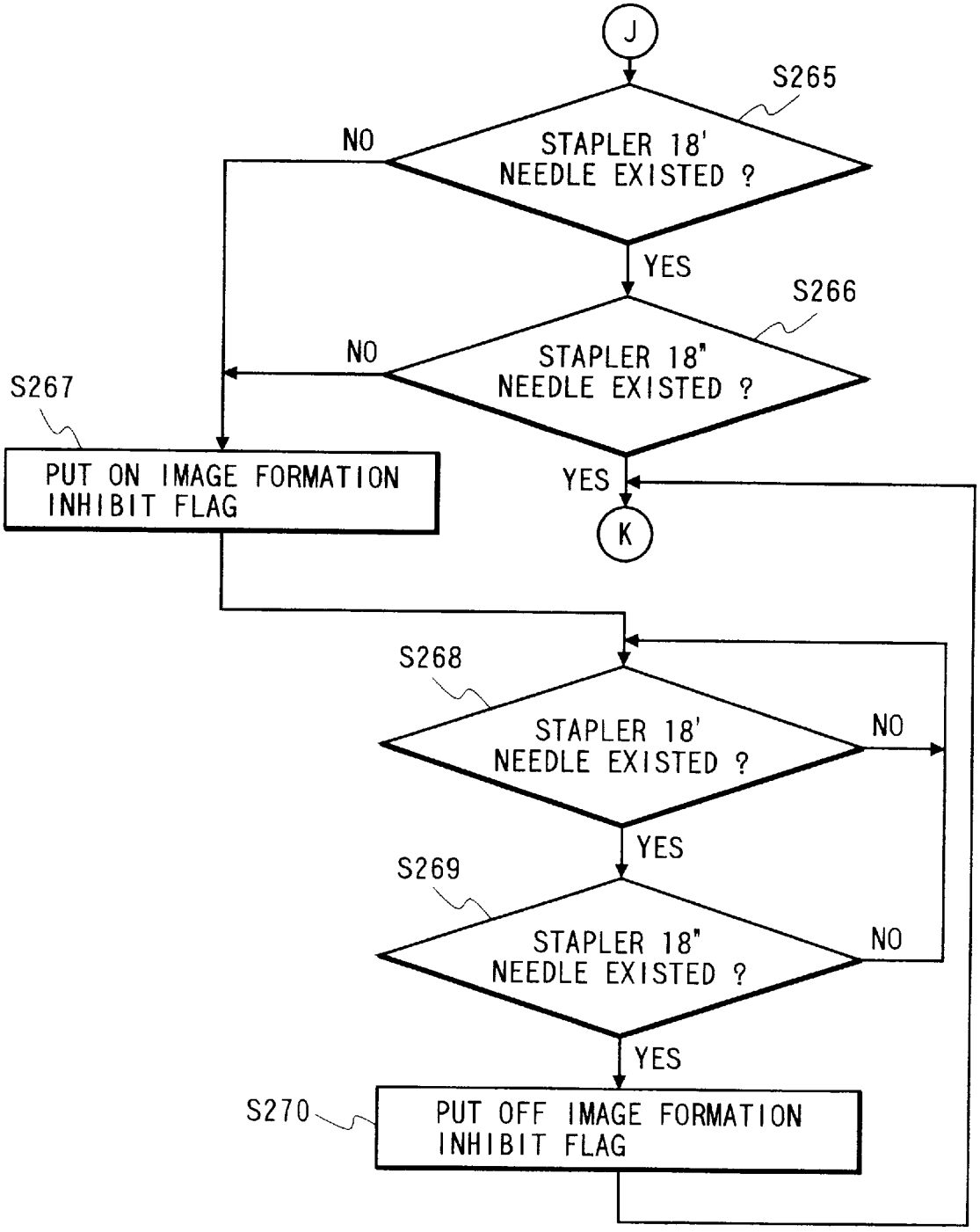
Figure 15B:
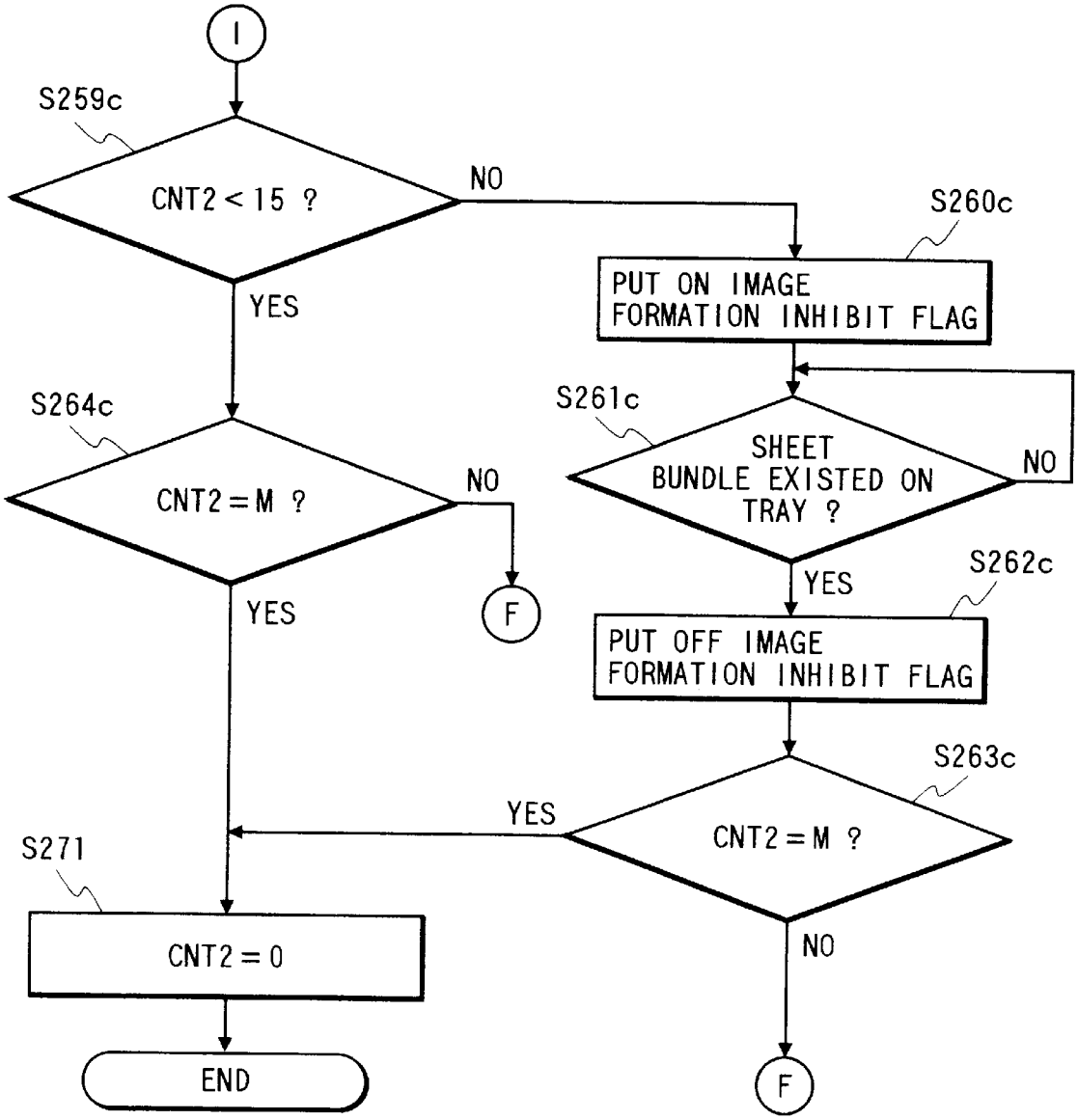

Then, "1" is added to a book-bind part counter CNT2 (step S258), and the program goes to a step S259*c* in FIG. 15B. In the step S259*c*, if it is judged that the counted number of the book-bind part counter CNT2 is greater than 15, the program goes to a step S260*c*, where the image formation prohibit flag is turned ON again, to thereby prohibit the image forming operation.

However, in the step S259, if it is judged that the counted number of the book-bind part counter CNT2 is smaller than 15 (smaller than tray capacity), the program goes to a step S264*c*, where it is judged whether desired parts are discharged. If the desired parts are not attained, the program returns to the step S201, whereas, if the desired parts are attained, the book-bind part counter CNT2 is reset to "0" (step S271), and the operation is finished.

In the step S259*c*, when it is judged that the counted number of the book-bind part counter CNT2 is greater than 15 and, in the step S260*c*, the image formation prohibit flag is turned ON again, to thereby prohibit the image forming operation, the program goes to a step S261*c*, where the image formation prohibit flag continues to be turned ON until the sheet bundle is removed from the discharge tray 32. Then, in the step S261*c*, it is judged that the sheet bundle is removed from the discharge tray 32, the program goes to a step S262*c*, where the image formation prohibit flag is turned OFF, thereby releasing the prohibition of the image forming operation.

Then, the program goes to a step S263*c*. If the counted number of the book-bind part counter CNT2 does not reach the desired number, the program returns to the step S201 in FIG. 12A again, to thereby repeat the book-binding operation.

Figure 16:
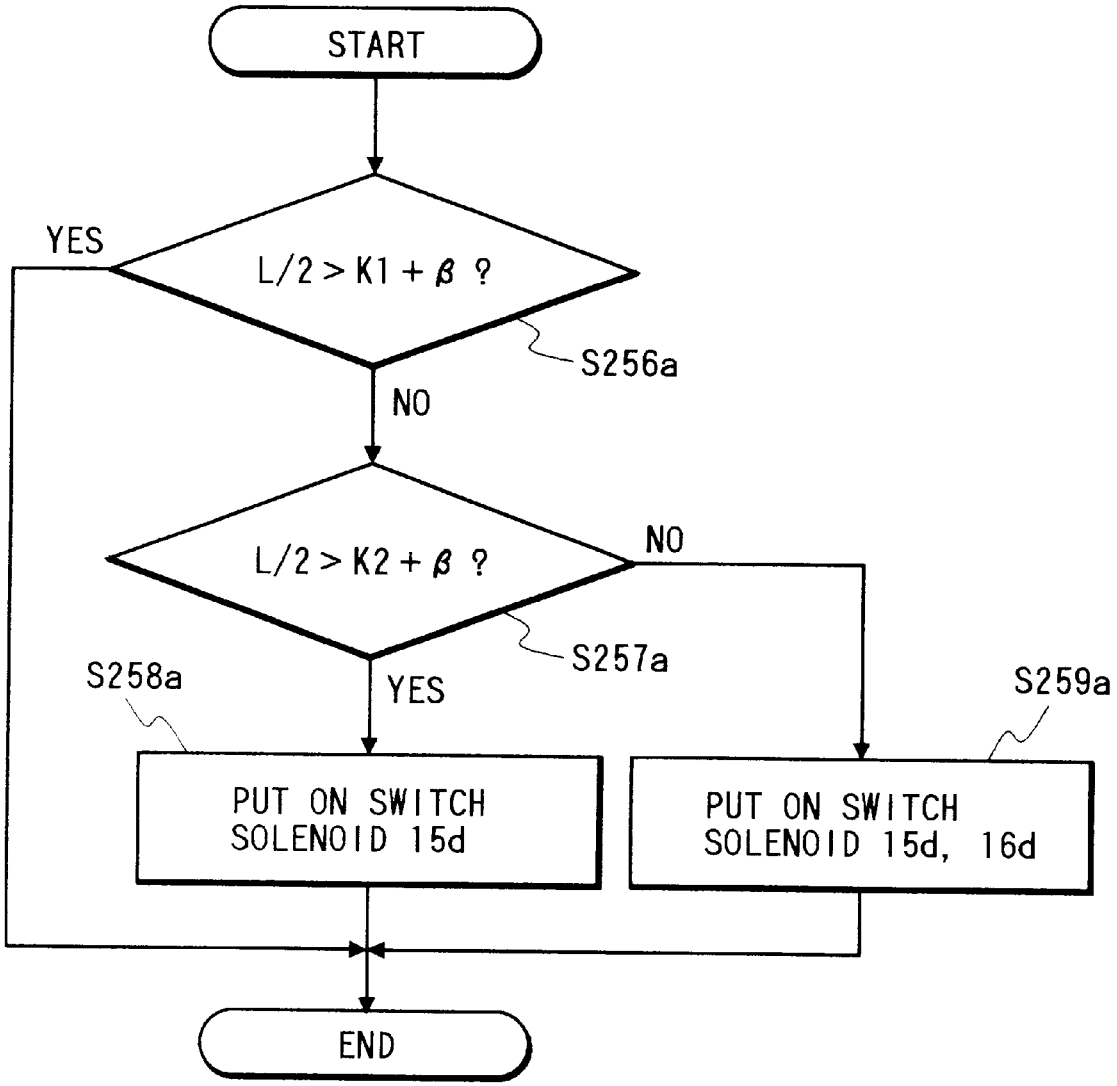
FIG. 16 is a flow chart showing control of a switch solenoid of the sheet processing apparatus.

Next, the control of the switch solenoids 15*d*, 16*d* will be explained with reference to FIGS. 10 and 16. If a half of the size of the sheet S (i.e., L/2) is greater than the sum (K1+β) of a length K1 (refer to FIG. 10) of the convey path from the switch flapper 15 to the staple position 19*a* along the sheet guides 11, 12 and a constant β (step S256*a* ), the switch solenoids 15*d*, 16*d* are remained in the OFF condition, and the operation is finished. Here, the constant β indicates the position of the trail end of the sheets S stacked when the sheet positioning member 23 is positioned at the proper position. The constant β is required to ensure that the next sheet S advanced to the stacked sheets S is surely rested on the uppermost sheet in the sheet stack without entering between the sheets in the sheet stack.

In the step S256*a*, if L/2 is greater than (K1+β), the program goes to a step S257*a*, where L/2 is compared with (K2+β). K2 is a length of the convey path from the switch flapper 16 to the staple position 19*a* along the sheet guides 11, 12 (refer to FIG. 10).

In the step S257*a*, if it is judged that L/2 is greater than (K2+β), the switch solenoid 15*d* is turned ON (step S258*a*) so that the sheet S is guided by the switch flapper 16. On the other hand, in the step S257*a*, if it is judged that L/2 is smaller than (K2+β), the switch solenoids 15*d*, 16*d* are turned ON (step S259*a* ) so that the sheets S are stacked along the sheet guide 11.

Figure 17:
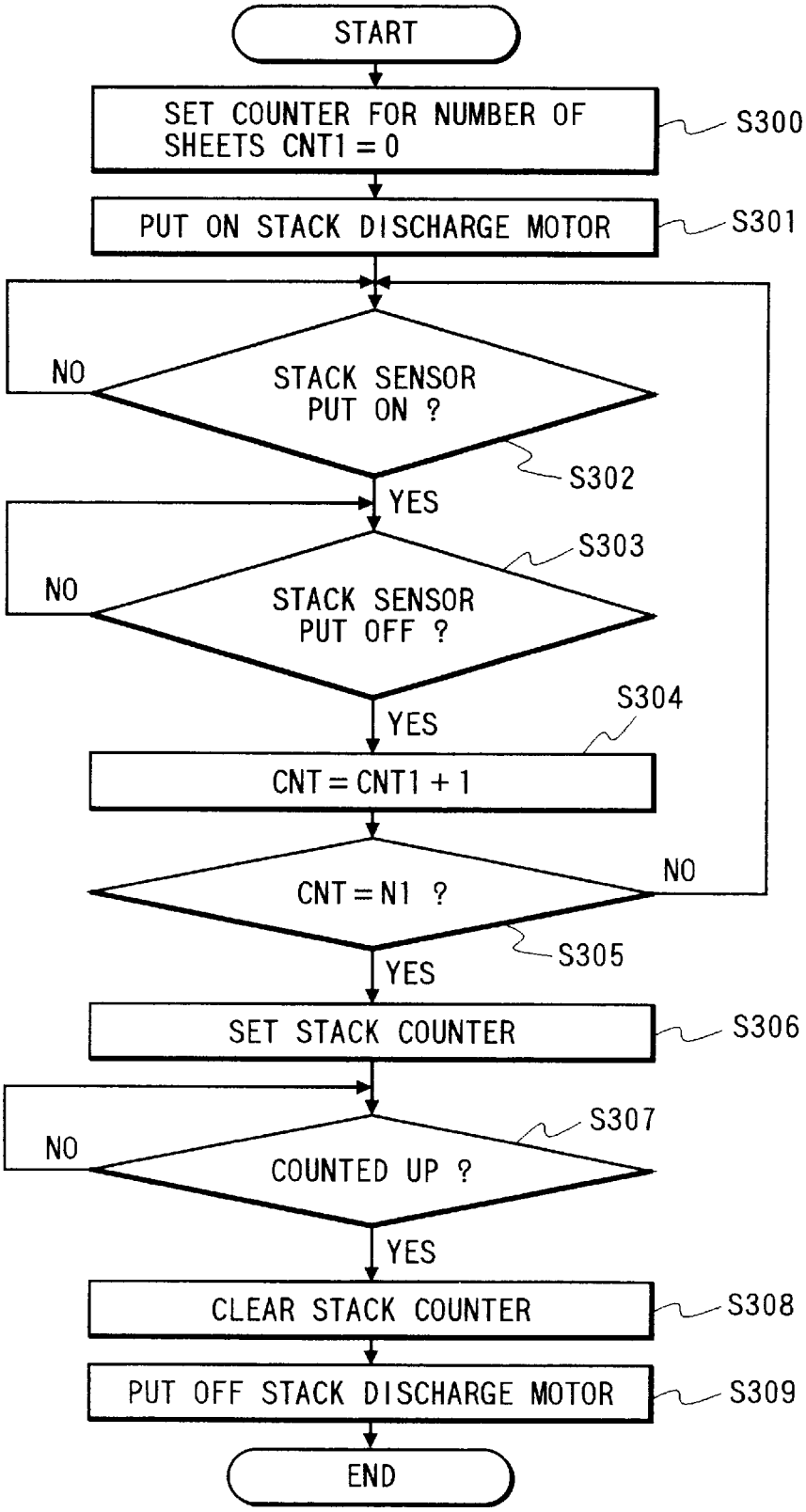
FIG. 17 is a flow chart showing a stack mode of the sheet processing apparatus.

Next, the stack mode will be explained with reference to FIG. 17. First of all, in a step S300, the sheet number counter CNT1 is set to "0". Then, the stack discharge motor 95 is turned ON (step S301) to rotate the stack discharge roller 5.

In a step S302, it is ascertained whether the stack sensor 84 is ON or OFF. If the stack sensor 84 is ON, it is ascertained when the stack sensor 84 is turned OFF (step S303). When the stack sensor 84 is turned OFF, "1" is added to the sheet number counter CNT1 (step S304), and it is judged whether the counted number of the sheet number counter CNT1 becomes equal to the desired number N1 (step S305). If the counted number of the sheet number counter CNT1 is not equal to the desired number N1, the program returns to the step S302.

If the counted number of the sheet number counter CNT1 reaches the desired number N1, after the sheet is conveyed by the predetermined amount (until the trail end of the sheet S leaves the stack sensor 84) (steps S306, S307), the stack discharge motor 95 is turned OFF (steps S308, S309).

Figure 18A:
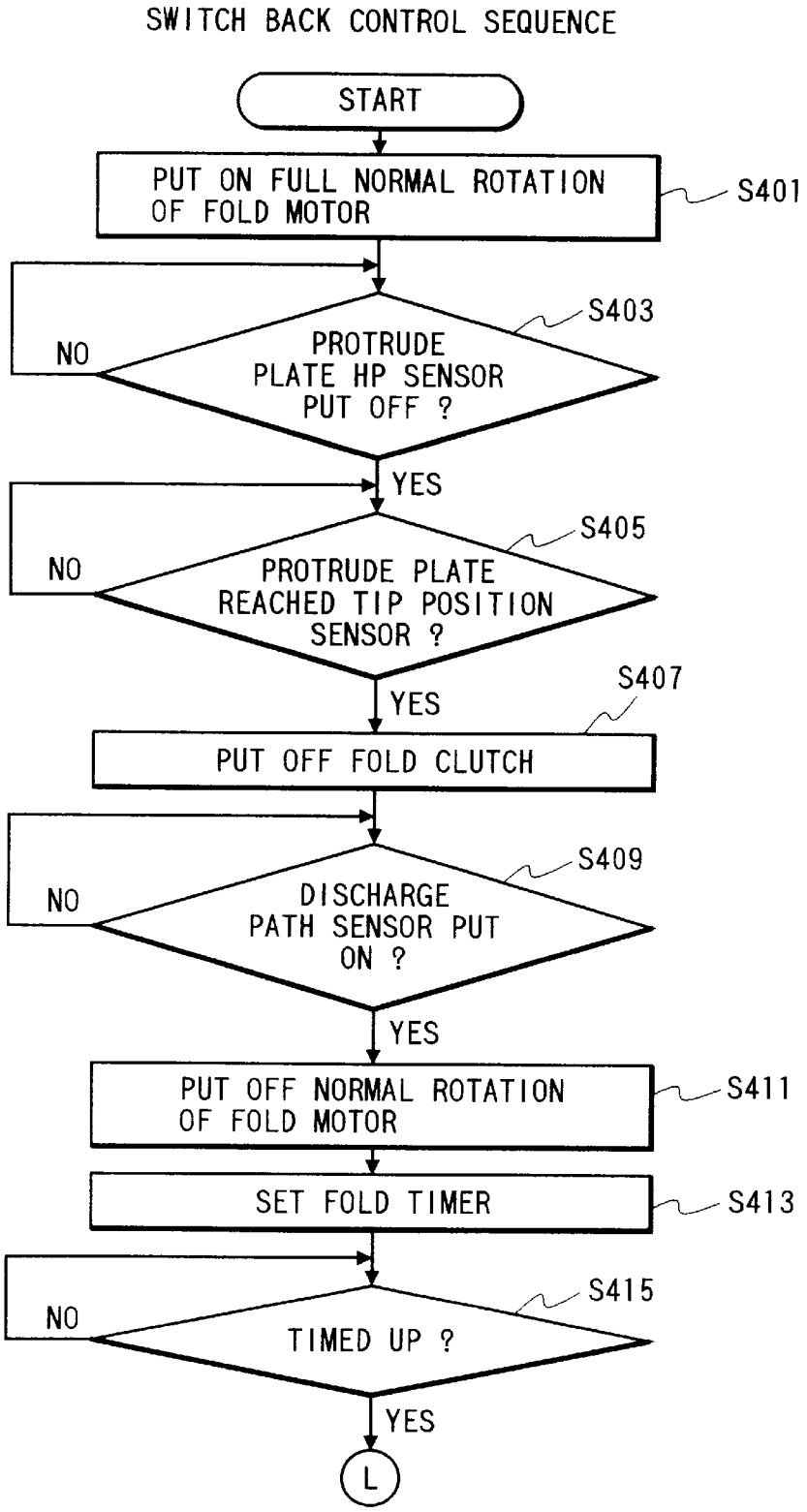
FIGS. 18A and 18B are flow charts showing a switch-back mode of the sheet processing apparatus.
Figure 18B:
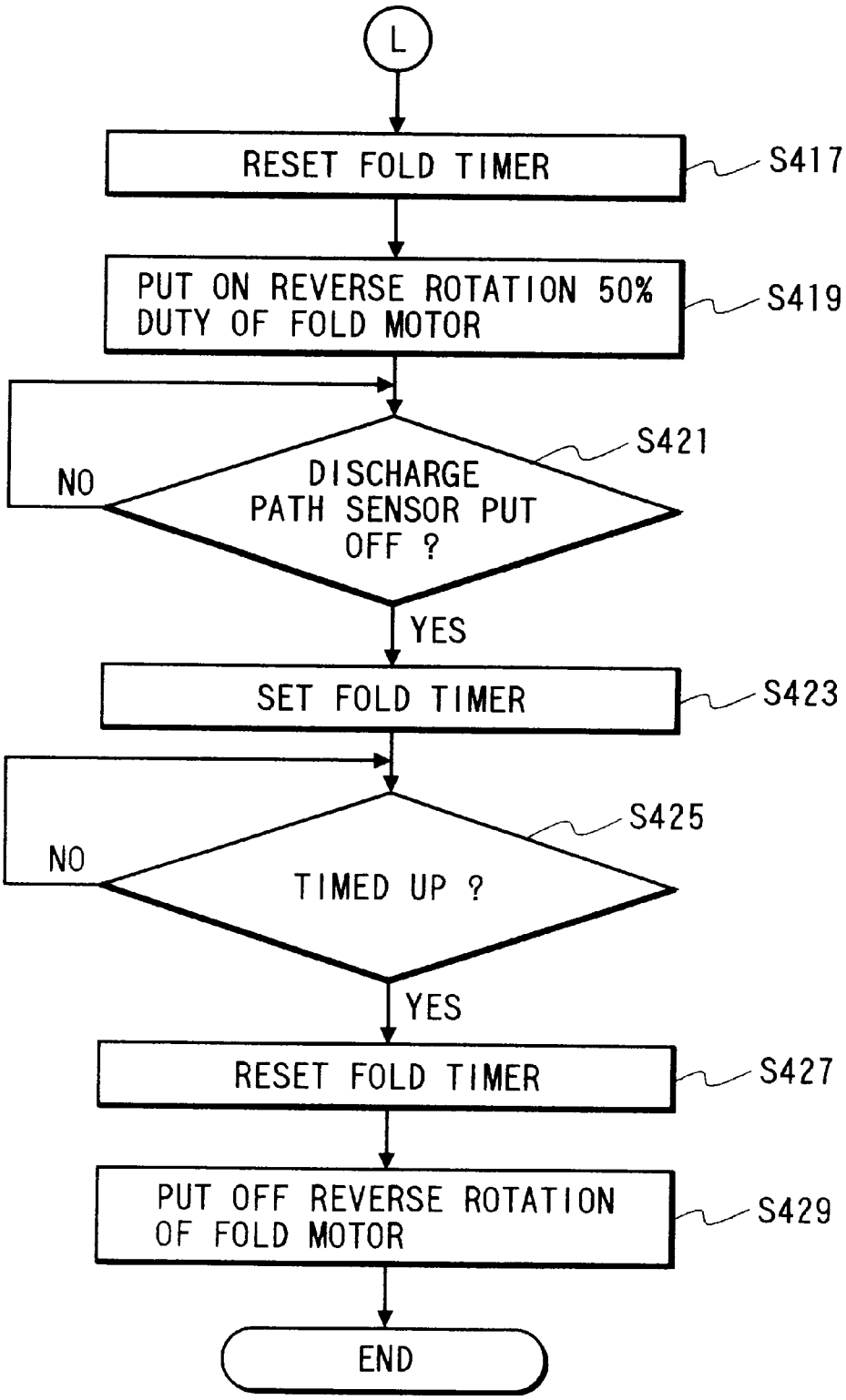

Next, the switch-back control means which is one of characteristics of the present invention will be explained with reference to FIGS. 18A and 18B. First of all, in a step S401, the fold motor 64 is turned ON fully, and it is waited that the protrude plate 25*a* leaves the protrude plate home position sensor 82*a* (step S403). Thereafter, if the protrude plate 25*a* reaches the protrude plate tip end detect sensor 82*b* (step S405), the fold clutch 74*a* is turned OFF to stop the protrude plate 25*a* (step S407), and it is waited that the discharge sensor 29 is turned ON (step S409).

If the discharge sensor 29 is turned ON by the reach of the tip end of the folded portion (end or folded line), the normal rotation of the fold motor 64 is stopped once (step S411) and a fold timer is set (step S413). If the fold timer is timed up (step S415), the fold timer is reset (step S417), and the fold motor is turned ON with duty of 50% to rotate it in the reverse direction (step S419). Incidentally, the fold rollers 26, 27 extends axially along the folded line of the sheet bundle.

Thereafter, if the discharge sensor 29 is turned OFF (step S412), in a timed relation to a time period required to bring the tip end of the folded portion to the nip of the pair of fold rollers 26, 27, the fold timer is set (step S423). If the fold timer is timed up (step S425), the fold timer is reset (step S427), and the reverse rotation of the fold motor 64 is turned OFF (step S429). In this way, the switch-back control sequence is ended. Thereafter, the program returns to the step S252 (fold sequence), and the folded sheet bundle is discharged at a normal speed.

With the arrangement as mentioned above, by controlling so that the return speed of the sheet S or the sheet bundle with respect to the pair of fold rollers (fold means) 26, 27 becomes slower than the advancing speed, the return speed for drawing the sheet bundle from the pair of fold rollers 26, 27 can be set smaller. Thus, the adequate pressure can be applied to the folded line of the sheet bundle, so that even when the thickness of the sheet bundle is relatively great, the swelling of the folded line of the sheet bundle can be reduced effectively, and the number of reciprocations of the sheet bundle with respect to the pair of fold rollers 26, 27 can be reduced, to thereby improve the productivity.

Further, since the number of reciprocations of the sheet bundle with respect to the pair of fold rollers 26, 27 can be reduced, unlike to the conventional techniques, the folded line and therearound of the sheet bundle is not smudged by the sliding contact between the sheet bundle and the pair of fold rollers 26, 27. Thus, the good quality of the article and improving the reliability of the apparatus can be maintained.

What is claimed is:

1. A sheet folding apparatus including a folding means for folding a sheet by feeding a folded portion of the sheet by a pair of rotary members in which the folded portion of the sheet is passed through a nip between said pair of rotary members by plural times by rotating said pair of rotary members in a normal direction and a reverse direction alternately;

characterized by a switch-back control means for controlling so that a return speed of the sheet obtained by said pair of rotary members becomes slower than an advancing speed of the sheet.

2. A sheet folding apparatus according to claim 1, wherein the folded portion of the sheet is formed by a folded portion forming means.

3. A sheet folding apparatus according to claim 2, wherein an end of the folded portion of the sheet formed by said folded portion forming means is shifted toward the nip of said pair of rotary members.

4. A sheet folding apparatus according to claim 3, wherein the end of folded portion of the sheet is pinched and conveyed by the nip of said pair of rotary members, to effect fold advancing operation.

5. A sheet folding apparatus according to claim 4, wherein said fold advancing operation is effected by normal rotation of said pair of rotary members, and thereafter, when the end of the folded portion of the sheet passes through said nip, said pair of rotary members are rotated in a reverse direction at a speed slower than the normal rotation to convey the sheet in a direction along which the end of the folded portion of the sheet is returned to said nip.

6. A sheet folding apparatus according to claim 5, wherein, when the end of the folded portion of the sheet is returned to said nip, said pair of rotary members are rotated in the normal direction to feed the end of the folded portion of the sheet and then to convey the entire sheet, to thereby discharge the sheet.

7. A sheet folding apparatus according to claim 1 or 6, wherein a mode in which the sheet is folded only by the normal rotation of said pair of rotary members can be selected, which mode is selected when a thickness of the single sheet, a thickness of a sheet bundle or the number of sheets is smaller than a predetermined value.

8. A sheet folding apparatus according to claim 7, further comprising a thickness detection means disposed upstream of said folding means for detecting the thickness of the sheet or the sheet bundle.

9. A sheet folding apparatus according to claim 7, further comprising a count means for counting the number of sheets to be stacked for folding.

10. A sheet folding apparatus according to claim 1 or 6, wherein said folding means folds the sheet along a center line of the sheet.

11. A sheet folding apparatus according to claim 10, further comprising a stacking means for stacking the sheets being fed, and a positioning means for positioning the stacked sheets by abutting against one end thereof so that the center line of the stacked sheets is opposed to said folding means.

12. A sheet folding apparatus according to claim 10, further comprising a stacking means for stacking the sheets being fed, a stapling means disposed upstream of said folding means for stapling the sheet bundle, a movable positioning means for positioning the sheets by abutting against one end of the stacked sheets so that the center line of the stacked sheets is opposed to said stapling means, and a control means for shifting said positioning means so that a center line of the stapled sheet bundle is opposed to said folding means.

13. A sheet folding apparatus according to claim 5, wherein said folded portion forming means has a protrude plate for pushing the sheet to form the folded portion, and, when said pair of rotary members are rotated in the reverse direction, said protrude plate is controlled to be held in the vicinity of the nip of said pair of rotary members.

14. A sheet folding apparatus according to claim 7, wherein said folded portion forming means has a protrude plate for pushing the sheet to form the folded portion, and, when said pair of rotary members are rotated in the reverse direction, said protrude plate is controlled to be held in the vicinity of the nip of said pair of rotary members, and, when said mode in which the sheet is folded only by the normal rotation of said pair of rotary members is selected, said protrude plate is then shifted reciprocally to return to its home position.

15. A sheet folding apparatus according to claim 1 or 5, wherein said pair of rotary members is a pair of rollers, and a sensor for detecting the fact that the folded portion passes through said nip is disposed downstream of said rollers in an advancing direction.

16. A sheet folding apparatus according to claim 15, wherein timings of the normal rotation and the reverse rotation of said pair of rollers are determined by said sensor and a timer operated by said sensor.

17. A sheet folding apparatus according to claim 2, wherein rotation control of said pair of rotary members is effected by a motor, said folded portion forming means has a protrude plate for pushing the sheet to form the folded portion, and said protrude plate is subjected to rotation of said motor so that said protrude plate is linearly reciprocated through a conversion mechanism.

18. A sheet folding apparatus according to claim 17, wherein said conversion mechanism has a rotary member and a link, and is connected to said motor through a one-way clutch.

19. A sheet folding apparatus according to claim 1 or 6, further comprising a pair of convey rotary members disposed downstream of said pair of rotary members in an advancing direction, and the folded sheet bundle is discharged onto a further downstream stack.

20. A sheet folding apparatus according to claim 5 or 17, wherein said protrude plate protrudes toward the sheet in a substantially horizontal direction.

21. An image forming apparatus comprising:

a sheet convey means for conveying a sheet;

an image forming means for forming an image on the sheet; and a sheet folding apparatus according to one of claims 1 to 6.

* * * * *

UNITED STATES PATENT AND TRADEMARK OFFICE

CERTIFICATE OF CORRECTION

PATENT NO. : 6,004,254

DATED : December 21, 1999

INVENTOR(S): MITSUSHIGE MURATA

It is certified that error appears in the above-identified patent and that said Letters Patent is hereby corrected as shown below:

COLUMN 3:

Line 44, "synchronous" should read --synchronism--.

COLUMN 6:

Line 8, "ends" should read --end--.

COLUMN 7:

Line 11, "ratatably" should read --rotatably--.

COLUMN 9:

Line 43, "motor" should read --motors--.

Line 60, "passe" should read --passed--.

UNITED STATES PATENT AND TRADEMARK OFFICE

CERTIFICATE OF CORRECTION

PATENT NO. : 6,004,254

DATED : December 21, 1999

INVENTOR(S): MITSUSHIGE MURATA

It is certified that error appears in the above-identified patent and that said Letters Patent is hereby corrected as shown below:

COLUMN 10:

Line 13, "part" should read --book-bind part--.

Line 20, "do" should read --does--.

COLUMN 13:

Line 13, "fact" should read --a fact--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*